US006580446B2

(12) United States Patent
Yamakawa et al.

(10) Patent No.: US 6,580,446 B2
(45) Date of Patent: Jun. 17, 2003

(54) THERMAL TRANSFER PRINTER, THERMAL TRANSFER RECORDING METHOD AND THERMAL TRANSFER RECORDING WEB ROLL

(75) Inventors: Noboru Yamakawa, Tokyo-To (JP); Hitoshi Saito, Tokyo-To (JP); Hiroaki Inoue, Tokyo-To (JP); Hisaki Ota, Tokyo-To (JP); Junichi Hiroi, Tokyo-To (JP)

(73) Assignee: Dai Nippon Printing Co., Ltd. (JP)

( * ) Notice: Subject to any disclaimer, the term of this patent is extended or adjusted under 35 U.S.C. 154(b) by 0 days.

(21) Appl. No.: 10/022,221

(22) Filed: Dec. 20, 2001

(65) Prior Publication Data

US 2002/0075375 A1 Jun. 20, 2002

(30) Foreign Application Priority Data

| | | |
|---|---|---|
| Dec. 20, 2000 | (JP) | 2000-387164 |
| Dec. 25, 2000 | (JP) | 2000-392445 |
| Dec. 25, 2000 | (JP) | 2000-393069 |
| Dec. 28, 2000 | (JP) | 2000-399770 |

(51) Int. Cl.[7] ..... B41J 15/04; B65H 16/02; B65H 16/10; B65H 18/28

(52) U.S. Cl. ..... 347/218; 400/611; 400/612; 400/613

(58) Field of Search ..... 347/218; 400/613, 400/611, 612; 242/159, 160.1, 160.3, 590, 596.7, 597, 597.1, 600

(56) References Cited

FOREIGN PATENT DOCUMENTS

| | | | |
|---|---|---|---|
| JP | 11-349197 | 12/1999 | |
| JP | 2001-139192 | * 5/2001 | ..... B65H/16/12 |

* cited by examiner

*Primary Examiner*—Huan Tran
(74) *Attorney, Agent, or Firm*—Parkhurst & Wendel, L.L.P.

(57) ABSTRACT

A thermal transfer printer includes a thermal transfer recording web roll having a bore and obtained by rolling a thermal transfer web. The segment of the thermal transfer recording web forming the innermost layer of the thermal transfer recording web roll is fixed to a part of a segment of the same forming the second innermost layer of the thermal transfer recording web roll. A holding device is inserted in the bore of the thermal transfer recording web roll to hold the thermal transfer recording web roll. The thermal transfer recording web roll and the holding device rotate in a unit to feed the thermal transfer recording web to a thermal transfer recording unit that forms images on the thermal transfer recording web. The thermal transfer recording web roll can be prepared at a low cost without requiring much time and effort.

33 Claims, 22 Drawing Sheets

THERMAL TRANSFER PRINTER, THERMAL TRANSFER RECORDING METHOD AND THERMAL TRANSFER RECORDING WEB ROLL

BACKGROUND OF THE INVENTION

1. Field of the Invention

The present invention relates to a thermal transfer printer capable of simply and quickly printing a thermal transfer image of an excellent image quality without using any feed core when a roll of thermal transfer recording web (hereinafter referred to as "thermal transfer recording web roll") is loaded into a thermal transfer printer, a thermal transfer recording method and a thermal transfer recording web roll.

2. Description of the Related Art

Various known thermal transfer recording methods use a thermal transfer sheet having a base sheet and a color transfer layer formed on the base sheet, and prints an image of a character, a figure or a pattern on a recording sheet by heating portions of the transfer color layer from behind with a thermal head or the like to transfer portions of the color transfer layer corresponding to yellow, magenta and cyan parts of the image to the recording sheet.

Known thermal transfer recording methods are classified by the type of the color transfer layer into thermal sublimation transfer recording methods and thermal melting transfer recording methods. The thermal sublimation transfer recording method uses a thermal transfer sheet formed by coating a base sheet with a transfer color layer of a binder containing sublimable dyes, heats the thermal transfer sheet from behind the same to sublimate and transfer the dyes contained in the transfer color layer to a recording sheet. The recording surface of the recording sheet is coated with a dye-recipient layer.

The thermal melting transfer recording method uses a thermal transfer sheet formed by coating a base sheet with a transfer color layer capable of being readily softened and melted by heating and of being transferred, and transfers portions of the transfer color layer to a recording sheet by heating the thermal transfer sheet from behind the same.

Both the thermal sublimation transfer recording method and the thermal melting transfer recording method are capable of forming both monochromatic images and multicolor images. The thermal transfer recording method uses a three-color thermal transfer sheet to print images in three colors, i.e., yellow, magenta and cyan, or a four-color thermal transfer sheet to print images in four colors, i.e., yellow, magenta, cyan and black, and records color images on recording sheets by transferring portions of the thermal transfer sheet corresponding to parts of those colors of images to recording sheets.

The thermal transfer recording method uses thermal transfer recording sheets, i.e., recording sheets, and feeds the thermal transfer recording sheets in a stack to a printer or uses a recording web and feeds the recording web in a recording web roll to a printer.

The thermal transfer printing is applied prevalently to mass printing in recent years and rolled thermal transfer recording webs are used prevalently. Generally, the thermal transfer recording web is wound in a roll on a feed core, i.e., a feed bobbin, the leading edge of the thermal transfer recording web is attached adhesively to a takeup core, i.e., a takeup bobbin, to take up the thermal transfer recording web on the takeup core or portions of the thermal transfer recording web used for thermal transfer printing are cut and discharged in sheets. The rolled thermal transfer web needs a feed core. The feed core is scrapped or reused after the rolled thermal transfer recording web has been exhausted. The core must be formed in a high dimensional accuracy to roll the thermal transfer web thereon uniformly without creasing the same and hence the core is costly.

The core of a rolled thermal transfer recording web comes into contact with the members of a driving unit of a printer when the roll of the thermal transfer recording web is rotated in the printer. Therefore, when a paper tube made principally of paper pulp and less expensive than a plastic tube is used to reduce printing cost, the paper tube is abraded frictionally by the members of the driving unit into paper powder, the paper powder is scattered in the printer, and forms pinholes that reduces image quality in printed matters produced by thermal transfer printing.

Time and effort are required for purchasing and storing feed cores, loading the same to a takeup mechanism and taking up the thermal transfer recording web.

SUMMARY OF THE INVENTION

The present invention has been made in view of such problems and it is therefore an object of the present invention to provide a printer capable of simply and quickly printing a thermal transfer image of an excellent image quality without using any feed core when a roll of thermal transfer recording web is loaded into a thermal transfer printer, a thermal transfer recording method and a thermal transfer recording web roll.

According to the present invention, a thermal transfer printer includes: a thermal transfer recording web roll having a bore and obtained by rolling a thermal transfer web, in which a segment of the thermal transfer recording web forming an innermost layer of the thermal transfer recording web roll is fixed to a part of a segment of the same forming a second innermost layer of the thermal transfer recording web roll;

a rotative driving mechanism inserted in the bore of the thermal transfer recording web roll; and a thermal transfer recording unit for recording images on the thermal transfer recording web unwound from the thermal transfer recording web roll held by the rotative driving mechanism.

In the thermal transfer printer according to the present invention, the segment of the innermost layer of the thermal transfer recording web roll excluding an inner edge part is fixed to the part of the second innermost layer, and the rotative driving mechanism includes a holding device for holding the inner edge part of the thermal transfer recording web.

In the thermal transfer printer according to the present invention, the holding device has a holding rod having a diameter substantially equal to that of the bore of the thermal transfer recording web roll, and having in its circumference with a recess for holding the inner edge part of the thermal transfer recording web.

In the thermal transfer printer according to the present invention, the holding device has a holding rod having a diameter substantially equal to that of the bore of the thermal transfer recording web roll, and having a groove to receive the inner edge part of the thermal transfer recording web.

In the thermal transfer printer according to the present invention, the holding device is provided with a pair of drive shafts for holding the inner edge part of the thermal transfer recording web.

In the thermal transfer printer according to the present invention, the rotative driving mechanism includes a pair of caps disposed on opposite end surfaces of the thermal transfer recording web roll, respectively, so as to be engaged in the bore of the thermal transfer recording web roll.

In the thermal transfer printer according to the present invention, at least one of the caps has elastic parts for applying pressure radially outward to an inner surface of the bore of the thermal transfer recording web roll.

In the thermal transfer printer according to the present invention, at least one of the caps has a flange in contact with the end surface of the thermal transfer recording web roll.

In the thermal transfer printer according to the present invention, one of the caps has elastic parts for applying pressure radially outward to an inner surface of the bore of the thermal transfer recording web roll, and the other cap has a part to be inserted into the former cap to press the elastic parts radially outward.

In the thermal transfer printer according to the present invention, each of the pair of caps is held in the bore of the thermal transfer recording web roll through a bushing provided with a slit.

In the thermal transfer printer according to the present invention, a slit is formed between the adjacent elastic parts of the cap.

In the thermal transfer printer according to the present invention, the segment of the inner end segment of the rolled thermal transfer recording web roll excluding an inner edge part is fixed to the part of the second innermost layer, and the inner edge part is inserted in the slit formed in the bushing or the slit of the cap.

In the thermal transfer printer according to the present invention, the rotative driving mechanism includes drive rollers disposed in the bore of the thermal transfer recording web roll in contact with an inner surface of the bore of the thermal transfer recording web roll.

In the thermal transfer printer according to the present invention, the rotative driving mechanism includes a pair of drive rollers, and the center distance between the pair of drive rollers is adjustable.

In the thermal transfer printer according to the present invention, the pair of drive rollers are biased away from each other.

In the thermal transfer printer according to the present invention, the drive rollers have a circumference provided with ridges or knobs.

In the thermal transfer printer according to the present invention, the rotative driving mechanism includes a plurality of drive rollers disposed in the bore of the thermal transfer recording web roll, and an endless belt extended around the plurality of drive rollers and pressed by the plurality of drive rollers so as to be in contact with an inner surface of the bore of the thermal transfer recording web roll.

In the thermal transfer printer according to the present invention, the rotative driving mechanism includes a pair of rotative driving members disposed at opposite end surfaces of the thermal transfer recording web roll and capable of applying pressure to the opposite end surfaces of the thermal transfer recording web roll.

In the thermal transfer printer according to the present invention, the pair of rotative driving members have taper side surfaces tapering toward the end surfaces of the thermal transfer recording web roll, respectively.

In the thermal transfer printer according to the present invention, the pair of rotative driving members are mounted on a center shaft inserted in the bore of the thermal transfer recording web roll.

In the thermal transfer printer according to the present invention, at least one of the pair of rotative driving members is pressed by a spring mounted on the center shaft against the end surface of the thermal transfer recording web roll.

In the thermal transfer printer according to the present invention, distance between the rotative driving members mounted on the center shaft is adjustable.

According to the present invention, a thermal transfer recording method includes the steps of: preparing a thermal transfer recording web roll having a bore and obtained by rolling a thermal transfer web, in which a segment of the thermal transfer recording web forming an innermost layer of the thermal transfer recording web roll is fixed to a part of a segment of the same forming a second innermost layer of the thermal transfer recording web roll; unwinding the thermal transfer recording web by engaging a rotative driving mechanism in the bore of the thermal transfer recording web roll and rotating the thermal transfer recording web roll by the rotative driving mechanism; and carrying out a thermal transfer recording operation to record an image on the thermal transfer recording web unwound from the thermal transfer recording web roll.

In the thermal transfer recording method according to the present invention, the segment of the innermost layer of the rolled thermal transfer recording web roll excluding an inner edge part is fixed to a part of the second innermost layer, and the thermal transfer recording web roll is driven for rotation by the rotative driving mechanism including a holding device holding the inner edge part of the thermal transfer recording web.

In the thermal transfer recording method according to the present invention, the rotative driving mechanism includes a pair of caps disposed at opposite end surfaces of the thermal transfer recording web roll, respectively, so as to be engaged in the bore of the thermal transfer recording web roll.

In the thermal transfer recording method according to the present invention, the rotative driving mechanism includes drive rollers disposed in the bore of the thermal transfer recording web roll in contact with an inner surface of the bore of the thermal transfer recording web roll.

In the thermal transfer recording method according to the present invention, the rotative driving mechanism includes a pair of rotative driving members disposed at opposite end surfaces of the thermal transfer recording web roll, respectively, and capable of applying pressure to the end surfaces of the thermal transfer recording web roll.

According to the present invention, a thermal transfer recording web roll to be used for a thermal transfer printer, has a bore, and is formed for rolling a thermal transfer recording web; wherein a segment of the thermal transfer recording web forming the innermost layer of the thermal transfer recording web roll is fixed to a part of a segment of the thermal transfer recording web forming the second innermost layer of the thermal transfer recording web roll.

In the thermal transfer recording web roll according to the present invention, the segment of the innermost layer of the thermal transfer recording web roll excluding an inner edge part is fixed to the second innermost layer of the thermal transfer recording web roll.

According to the present invention, the thermal transfer recording web roll does not need any feed core, is inexpensive, can be prepared without requiring time and effort, and is capable of recording a thermal transfer image in a satisfactory image quality.

According to the present invention, the segment of the innermost layer of the thermal transfer recording web roll, excluding an inner end part, of the thermal transfer recording web roll is fixed to the part of the second innermost layer, and the rotative driving mechanism includes a pair of flanged tubular shafts each having a tubular part provided with a slit.

According to the present invention, the tubular part of one of the flanged tubular shaft is inserted into the tubular part of the other flanged tubular shaft.

According to the present invention, the pair of flanged tubular shafts are driven individually by separate driving mechanisms, respectively.

According to the present invention, one of the flanged tubular shafts is provided with a central rod connected to the other flanged shaft.

According to the present invention, the pair of flanged tubular shafts are supported for rotation by support members, respectively.

According to the present invention, the thermal transfer recording method uses a thermal transfer recording web roll in which the segment of the innermost layer of the thermal transfer web roll excluding an inner end part, is fixed to the part of the second innermost layer, and the thermal transfer web roll is driven for rotation by the rotative driving mechanism including a pair of flanged tubular shafts each having a tubular part provided with a slit.

DESCRIPTION OF THE PREFERRED EMBODIMENTS

First Embodiment

A thermal transfer printer in a first embodiment according to the present invention will be described with reference to FIGS. 1 to 9.

Figure 1:
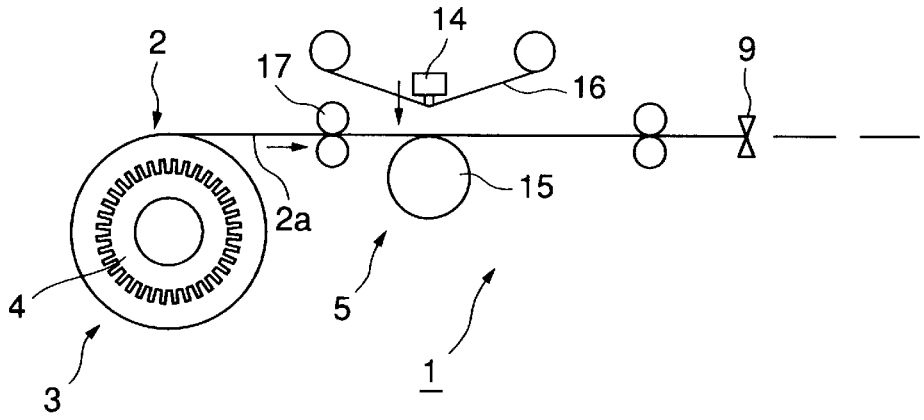
FIG. 1 is a schematic view of a thermal transfer printer in a first embodiment according to the present invention.

Referring to FIG. 1, a thermal transfer printer 1 has a thermal transfer recording web roll 2, a recording web feed unit 3 holding the thermal transfer recording web roll 2 therein, a thermal transfer recording unit 5 for recording images by a thermal transfer recording method on a thermal transfer recording web 2*a* unwound from the thermal transfer recording web roll 2, and a cutting unit 9 for cutting the thermal transfer recording web 2*a* into sheets.

Figure 2:
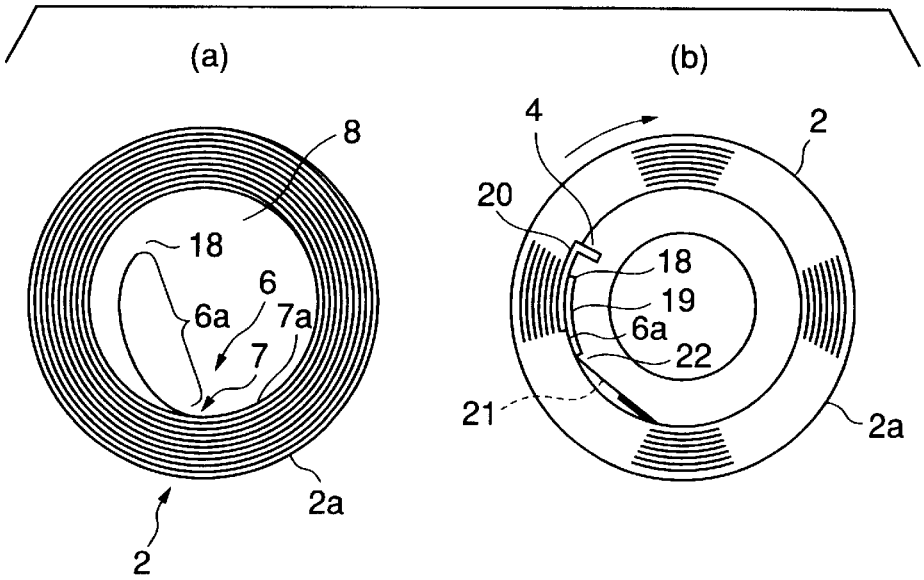
FIGS. 2(*a*) and 2(*b*) are end views of a thermal transfer recording web roll.

As shown in FIG. 2(*a*), the thermal transfer recording web roll 2 is formed by rolling the thermal transfer recording web 2*a*. A part 7 of the innermost layer 6 of the thermal transfer recording web roll 2 is bonded to the second innermost layer 7*a* of the thermal transfer recording web roll 2, leaving an inner end segment 6*a* in a free state. The recording web feed unit 3 is provided with a holding device (rotative driving mechanism) 4. The holding device 4 is inserted in the bore 8 of the thermal transfer recording web roll 2. The diameter of the holding device 4 is approximately equal to that of the bore 8 of the thermal transfer recording web roll 2.

The thermal transfer recording web 2*a* is pulled out from the recording web feed unit 3 by feed rollers 17, i.e., an upper pinch roller and a lower grip roller, in the direction of the arrow such that the leading edge of a section of the thermal transfer recording web 2*a* is located at a print-starting position. Then, the feed rollers 17 are reversed and the thermal transfer recording web roll 2 is turned in a winding direction to move the thermal transfer recording web 2*a* for printing in a direction opposite to the direction of the arrow.

The thermal transfer recording web 2*a* is extended tautly between the holding device 4 and the feed rollers 17. An operation for feeding and winding the thermal transfer recording web 2*a* is controlled mainly by rotating the feed rollers 17 in the normal or the reverse direction. The holding device 4 is interlocked with the feed rollers 17 so as to rotate the thermal transfer recording web roll 2 according to the rotation of the feed rollers 17 to unwind or wind the thermal transfer recording web 2*a* subordinately to the operation of the feed rollers 17. Although it is preferable that the thermal transfer recording web roll 2 does not slip relative to the holding device 4, the thermal transfer recording web roll 2 may slip in some degree relative to the holding device 4, provided that the thermal transfer recording web 2*a* is not creased.

The thermal transfer recording unit 5 is provided with a thermal transfer sheet 16 and a thermal head 14. The thermal head 14 is brought into contact with the back surface of the thermal transfer sheet 16. The thermal transfer recording web 2*a* is extended with its recording surface in contact with the surface coated with a transfer layer (the front surface) of the thermal transfer sheet 16. A platen roller 15 is disposed opposite to the thermal head 14 so as to be in contact with the back surface of the thermal transfer recording web 2*a*. When printing an image by thermal transfer recording on the thermal transfer recording web 2*a*, the thermal head 14 is lowered in the direction of the arrow to transfer a color image from the thermal transfer sheet 16 to the thermal transfer recording web 2*a*.

Preferably, two guide members, not shown, are extended along the opposite side edges of the thermal transfer recording web 2*a*, respectively, between the recording web feed unit 3 and the thermal transfer recording unit 5 to prevent the thermal transfer recording web 2*a* from meandering.

Desirably, the distance between the two guide members is adjustable according to the width of the thermal transfer recording web 2*a*. For example, pins and dice which engage with each other are attached to parts of the thermal transfer printer 1 to which the guide members are attached, the plurality of dice are attached to a member, and the member provided with the dice and a member provided with the pins are slid relative to each other. The pins are fitted in the dice located at positions corresponding to the width of the thermal transfer recording web 2*a*. Thus, the thermal transfer recording web 2*a* slides along the guide members, the guide members restrain the thermal transfer recording web 2*a* from lateral movement and hence the thermal transfer recording web 2*a* is prevented from meandering.

The cutting unit 9 of the thermal transfer printer 1 cuts the thermal transfer recording web 2*a* into sheets. The printed thermal transfer recording web 2*a* may be taken up in a printed thermal transfer recording web roll.

FIGS. 2(*a*) and 2(*b*) are views of assistance in explaining a thermal transfer recording web roll according to the present invention. As shown in FIG. 2(*a*), a thermal transfer recording web 2*a* is rolled in a thermal transfer recording web roll 2. Apart 7 of the innermost layer 6 at a predetermined distance from the inner edge of the thermal transfer recording web 2*a* of the thermal transfer recording web roll 2 is bonded to the second innermost layer of the thermal transfer recording web roll 2, leaving a free inner end segment 6*a*. The part 7 may be bonded to the second innermost layer of the thermal transfer recording web roll 2 with a single-coated adhesive tape, a double-coated adhesive tape, a liquid or solid adhesive or with a staple. The thermal transfer recording web roll 2 is a coreless roll having a central bore 8.

The inner end segment 6*a* of the thermal transfer recording web roll 2 shown in FIG. 2(*a*) is clamped by the holding device 4 of the thermal transfer printer 1 as shown in FIG. 2(*b*). The holding device 4 is inserted in the bore 8 of the thermal transfer recording web roll 2, and the inner end segment 6*a* of the innermost layer 6 is fixedly clamped by the holding device 4. The holding device 4 of the thermal transfer printer 1 is provided with a recess 19 extending along the inner circumference of the bore 8 of the thermal transfer recording web roll 2. The inner end segment 6*a* of the innermost layer 6 of the thermal transfer recording web roll 2 is placed in the recess 19. A pressing member 20 is placed opposite to the recess 19 to press the inner end segment 6*a* of the innermost layer 6 of the thermal transfer recording web roll 2 against the bottom surface of the recess 19 to fasten the inner end segment 6*a* to the holding device 4.

An opening 21 is formed in the inner end segment 6*a* of the innermost layer 6. A projection 22 formed in a front part of the recess 19 is engaged in the opening 21. The projection 22 is engaged in the opening 21 of the inner end segment 6*a* of the innermost layer 6, the inner end segment 6*a* is fastened to the recess 19 of the holding device 4, and then the thermal transfer recording web 2*a* is wound in the direction of the arrow shown in FIG. 2(*b*). Since the projection 22 is engaged in the opening 21 of the thermal transfer recording web 2*a*, the thermal transfer recording web roll 2 does not slip relative to the holding device 4, and the separation of the inner end segment 6*a* of the innermost layer 6 of the thermal transfer recording web 2*a* from the holding device 4 can be prevented.

When the thermal transfer recording web roll 2 needs to be replaced with another one before the thermal transfer recording web 2*a* of the same is exhausted, the thermal transfer recording web roll 2 may be removed from the holding device 4 of the thermal transfer printer 1 by sliding the thermal transfer recording web roll 2 relative to the holding device 4.

The holding device 4 has the shape of a shaft and is provided with the recess 19 (groove). The inner end segment 6*a* of the innermost layer 6 placed in the recess 19 is held fixedly in place by the pressing member 20 to fasten the holding device 4 to the thermal transfer recording web roll 2. A holding device provided with a groove for holding the innermost layer 6 in its inner part may be used; part of the innermost layer 6 is inserted in the groove and the thermal transfer recording web roll 2 and the holding device can be fastened together without using any pressing member.

Figure 3:
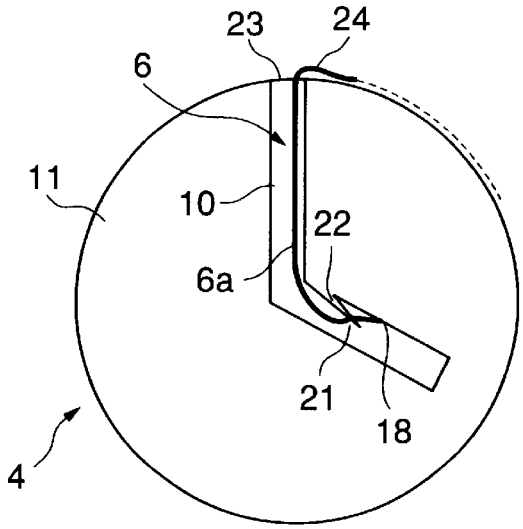
FIG. 3 is a schematic plan view of a holding device for holding an inner end part of a thermal transfer recording web.

FIG. 3 shows such a holding device 4 including a shaft 11 provided with a groove 10. The inner end segment 6*a* of the innermost layer 6 of the thermal transfer recording web 2*a* is inserted through an opening 23 formed in the circumference of the holding device 4 in the groove 10. An opening 21 is formed in a part of the innermost layer 6, at a short distance from the inner edge 18 of the innermost layer 6, and a projection 22 formed in the bottom of the groove 10 is engaged in the opening 21 to hold the innermost layer 6 on the holding device 4. The innermost layer 6 of the thermal transfer recording web 2*a* is fixed to the holding device 4, rotative driving force of the thermal transfer printer 1 is transmitted to the holding device 4 during the thermal transfer printing operation, the holding device 4 and the thermal transfer recording web roll 2 rotate together during the thermal transfer printing operation, and the innermost layer 6 of the thermal transfer recording web 2*a* does not come off the holding device 4.

In order that a part 24 of the thermal transfer recording web 2*a* extending around the opening 23 can extend close to the circumference of the shaft 11 of the holding device in a state where the holding device 4 shown in FIG. 3 and the thermal transfer recording web roll 2 are fastened together, it is preferable that the part 24 is perforated or pressed to make the part 24 flexible.

Figure 4:
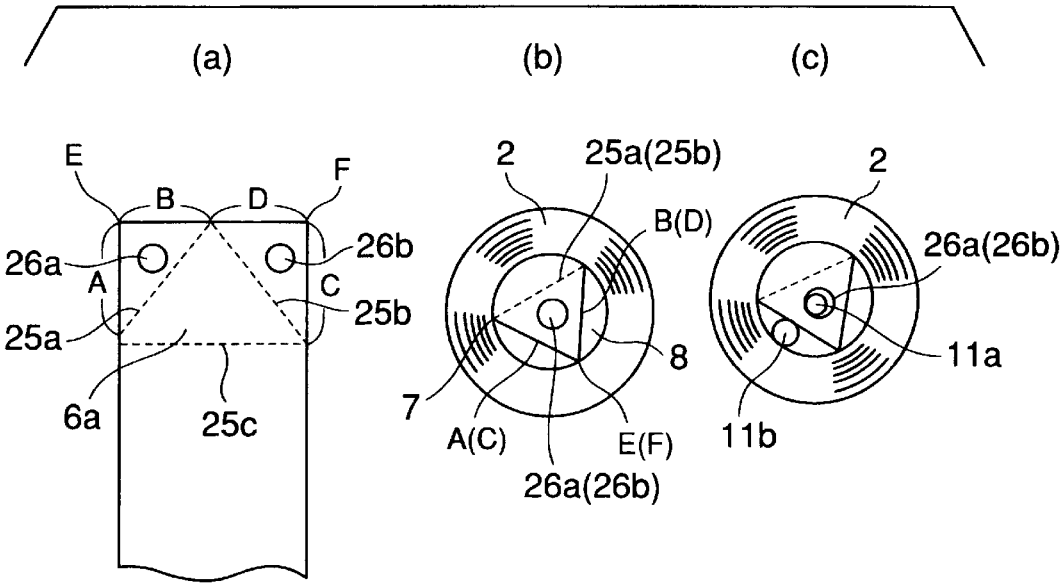
FIGS. 4(*a*), 4(*b*) and 4(*c*) are views of a holding device for holding an inner end segment of a thermal transfer recording web rolled in a thermal transfer recording web roll in a preferred embodiment according to the present invention.

FIGS. 4(*a*), 4(*b*) and 4(*c*) are views of a holding device for holding an inner end segment of a thermal transfer recording web. As shown in FIG. 4(*a*), perforated lines 25*a* and 25*b* are formed symmetrically and through holes 26*a* and 26*b* are formed symmetrically in an inner end segment 6*a* of the innermost layer 6 of a thermal transfer recording web 2. Triangular corner parts of the inner end segment 6*a* are bent in the same direction such that sides B and D are joined and corners E and F are joined. Thus, a triangle having sides A, B and 25*a* (perforated line) and a triangle having sides C, D and 25*b* (perforated line) are formed in the bore 8 of the thermal transfer recording web roll 2. The through holes 26*a* and 26*b* are at the centers of those triangles, respectively. A part of the innermost layer 6 of the thermal transfer recording web roll 2 is bonded to the second innermost layer of the thermal transfer recording web roll 2. A perforated line 25*c* is formed in the innermost layer 6 as shown in FIG. 4(*a*) so that the triangles are positioned in the bore 8 with their centers coincided with the axis of the bore 8.

The through holes 25*a* and 25*b* are axially aligned in the bore 8 of the thermal transfer recording web roll 2 in a state shown in FIG. 4(*b*), and a shaft 11*a* included in the holding device 4 is passed through the through holes 25*a* and 25*b* as shown in FIG. 4(*c*).

The inner end segment 6*a* of the innermost layer 6 is inserted in a space between the shaft 11*a* and a shaft 11*b* inserted in the bore 8 as shown in FIG. 4(*c*). The shafts 11*a* and 11*b* and the thermal transfer recording web roll 2 rotate together. Base end parts of the shafts 11*a* and 11*b* are connected and are rotated through gears or the like by the rotative driving force of the thermal transfer printer 1. Thus, the shafts 11*a* and 11*b* move in a body and serve as drive shafts.

Figure 5:
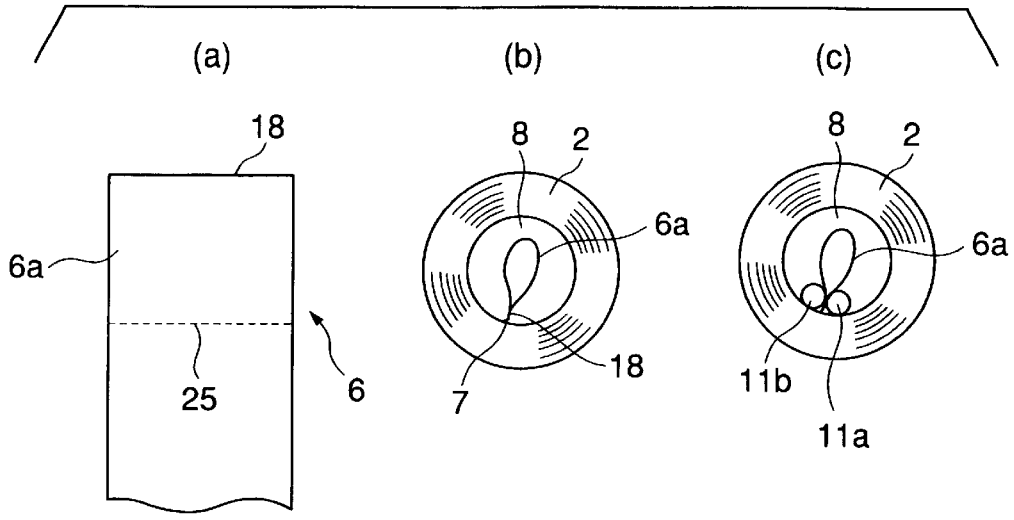
FIGS. 5(*a*), 5(*b*) and 5(*c*) are views of a thermal transfer recording web roll in a preferred embodiment according to the present invention.

FIGS. 5(*a*), 5(*b*) and 5(*c*) are views of a thermal transfer recording web roll 2 according to the present invention. As shown in FIG. 5(*a*), a perforated line 25 is formed in a part of an inner end segment 6*a* of the innermost layer 6 of the thermal transfer recording web roll 2 at a distance from the inner edge 18 of the inner end segment 6*a*. The inner end segment 6*a* is bent along the perforated line 25. As shown in FIG. 5(*b*), a part 7 of the innermost layer 6 is bonded to the second innermost layer of the thermal transfer recording web roll 2 with a single-coated adhesive tape, a double-coated adhesive tape, a liquid or solid adhesive or with a staple. Thus, the thermal transfer recording web roll 2 is a coreless roll having a central bore 8.

The inner end segment 6*a* of the innermost layer 6 of the thermal transfer recording web 2*a* is bent in a closed curve in the bore 8, and the inner edge 18 is bonded to the thermal transfer recording web 2*a* as shown in FIG. 5(*b*).

When loading the thermal transfer recording web roll 2 into the recording web feed unit 3 of the thermal transfer printer 1, shafts 11*a* and 11*b* included in the holding device 4 of the thermal transfer printer 1 are inserted in the bore 8 so as to lie near the inner end edge 18. The shafts 11*a* and 11*b* roll along the side surface of the bore 8 toward each other to hold the innermost layer 6 between them. The shafts 11*a* and 11*b* turn together with the thermal transfer recording web roll 2. Base end parts of the shafts 11*a* and 11*b* are connected and are driven for turning through gears or the like by the rotative driving force of the thermal transfer printer 1 for turning in a body.

Figure 6:
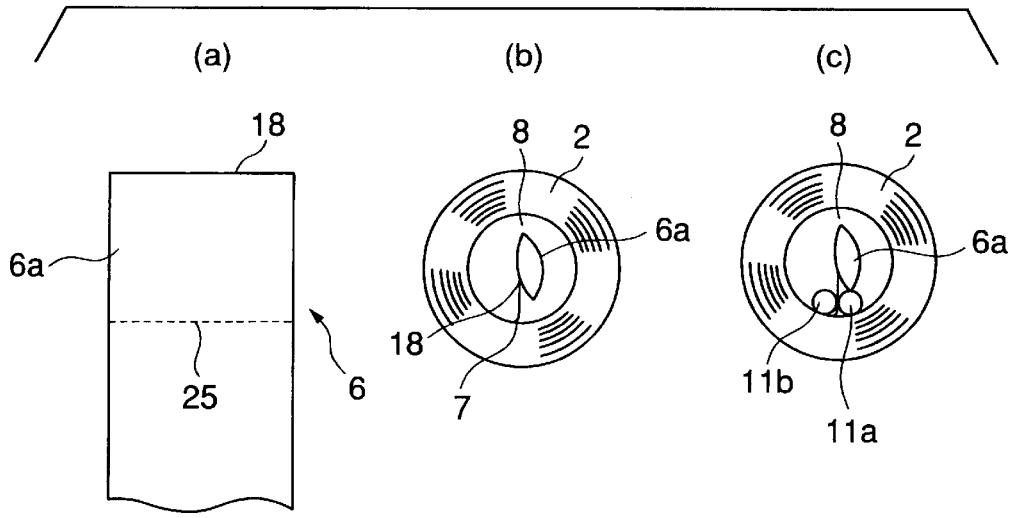
FIGS. 6(*a*), 6(*b*) and 6(*c*) are views of a thermal transfer recording web roll in a preferred embodiment according to the present invention.

FIGS. 6(*a*), 6(*b*) and 6(*c*) are views of a thermal transfer recording web roll 2 according to the present invention. As shown in FIG. 6(*a*), a perforated line 25 is formed in a part of an inner end segment 6*a* of the innermost layer 6 of the thermal transfer recording web roll 2 at a distance from the inner edge 18 of the inner end segment 6*a*. The inner end segment 6*a* is bent along the perforated line 25. As shown in FIG. 6(*b*), a part 7 of the innermost layer 6 is bonded to the second innermost layer of the thermal transfer recording web roll 2.

The inner end segment 6*a* of the innermost layer 6 of the thermal transfer recording web 2*a* is bent in a closed curve in the bore 8, and the inner edge 18 is bonded to the thermal transfer recording web 2*a* as shown in FIG. 6(*b*).

When loading the thermal transfer recording web roll 2 into the recording web feed unit 3 of the thermal transfer printer 1, shafts 11*a* and 11*b* included in the holding device 4 of the thermal transfer printer 1 are inserted in the bore 8 so as to lie near the inner end edge 18 as shown in FIG. 6(*c*). The shafts 11*a* and 11*b* roll along the side surface of the bore 8 toward each other to hold the innermost layer 6 between them. The shafts 11*a* and 11*b* turn together with the thermal transfer recording web roll 2. Base end parts of the shafts 11*a* and 11*b* are connected and are driven for turning through gears or the like by the rotative driving force of the thermal transfer printer 1 for turning in a body.

The closed curve in which the inner end segment 6*a* of the thermal transfer recording web 2*a* of the thermal transfer recording web roll 2 shown in FIG. 6 is different from that in which the inner end segment 6*a* of the thermal transfer recording web 2*a* of the thermal transfer recording web roll 2 shown in FIG. 5.

Figure 7:
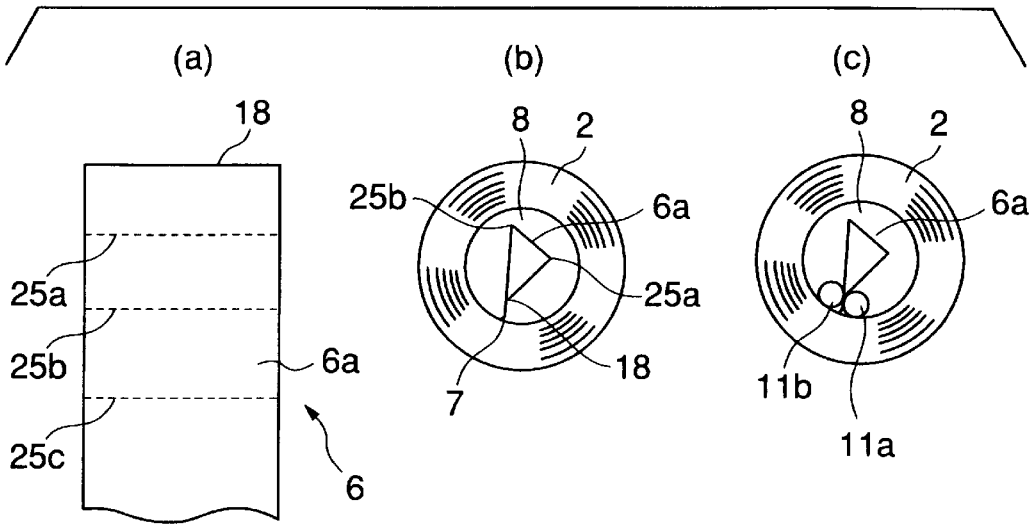
FIGS. 7(*a*), 7(*b*) and 7(*c*) are views of a thermal transfer recording web roll in a preferred embodiment according to the present invention.

FIGS. 7(*a*), 7(*b*) and 7(*c*) are views of a thermal transfer recording web roll 2 according to the present invention. As shown in FIG. 7(*a*), three perforated lines 25*a*, 25*b* and 25*c* are formed in parts of an inner end segment 6*a* of the innermost layer 6 of the thermal transfer recording web roll 2 at distances from the inner edge 18 of the inner end segment 6*a*. The inner end segment 6*a* is bent along the perforated lines 25*a* and 25*b* such that the end edge 18 touches a part of the inner end segment 6*a* between the perforated lines 25*b* and 25*c* to form a triangle in the bore 8 of the thermal transfer recording web roll 2 as shown in FIG. 7(*b*). The end edge 18 at one of the vertices of the triangle is bonded to the side surface of the bore 8 by the aforesaid means.

The inner end segment 6*a* of the innermost layer 6 of the thermal transfer recording web 2*a* is bent along the perforated line 25*c* and a part 7 of the inner end segment 6*a* is bonded to the second innermost layer of the thermal transfer recording web roll 2 as shown in FIG. 7(*b*) by the aforesaid bonding means. The thermal transfer recording web roll 2 is a coreless roll having a central bore 8.

When loading the thermal transfer recording web roll 2 into the recording web feed unit 3 of the thermal transfer printer 1, shafts 11*a* and 11*b* included in the holding device 4 of the thermal transfer printer 1 are inserted in the bore 8 so as to lie near the inner end edge 18. The shafts 11*a* and 11*b* roll along the side surface of the bore 8 toward each other to hold the innermost layer 6 between them. The shafts 11*a* and 11*b* turn together with the thermal transfer recording web roll 2. Base end parts of the shafts 11*a* and 11*b* are connected and are driven for turning through gears or the like by the rotative driving force of the thermal transfer printer 1 for turning in a body.

Figure 8:
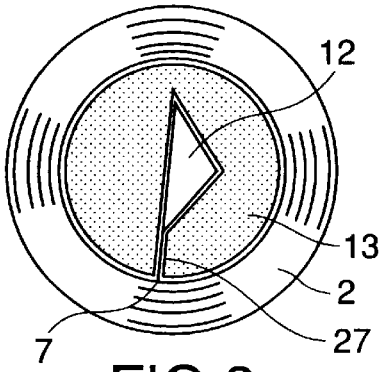
FIG. 8 is schematic end view of a holding device for holding an inner end part of a thermal transfer recording web rolled in a thermal transfer recording web roll according to the present invention.

Although the inner end segments 6*a* of the thermal transfer recording web rolls 2 shown in FIGS. 5, 6 and 7 are bent in the closed curves and the triangle, respectively, in the bore 8, the inner end segments 6*a* may be bent in any optional shape, such as any closed curve or any polygon. The holding device 4 is not limited to those shown in FIGS. 5, 6 and 7 each including the two shafts 11*a* and 11*b*, but may be any suitable device. For example, the holding device 4 may include a shaft 13 of a diameter equal to that of the bore 8 of the thermal transfer recording web roll 2 as shown in FIG. 8. The shaft 13 is provided with a cavity 12 conforming to the inner end segment 6*a* shaped in the closed curve or the polygon in the bore 8, a groove 27 having an open end 7*a* and connected to the cavity 12. The shaft 13 has a cylindrical shape coinciding with the bore 8 of the thermal transfer recording web roll 2.

Figure 9:
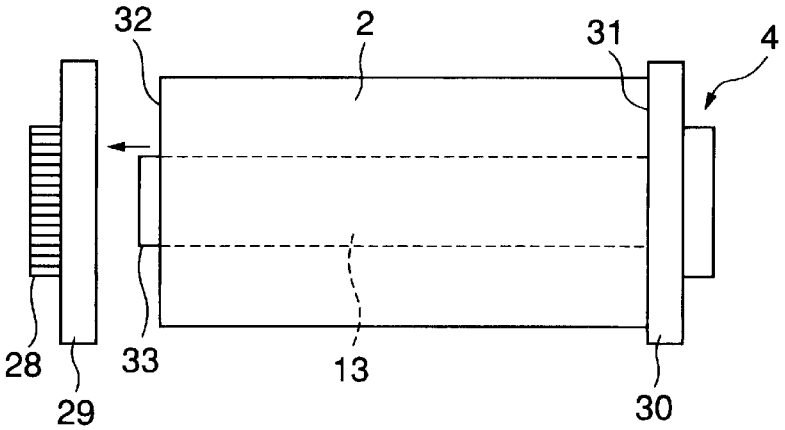
FIG. 9 is a side elevation of assistance in explaining an operation for loading a thermal transfer recording web roll into a recording web feed unit included in the thermal transfer printer of the present invention.
Figure 10:
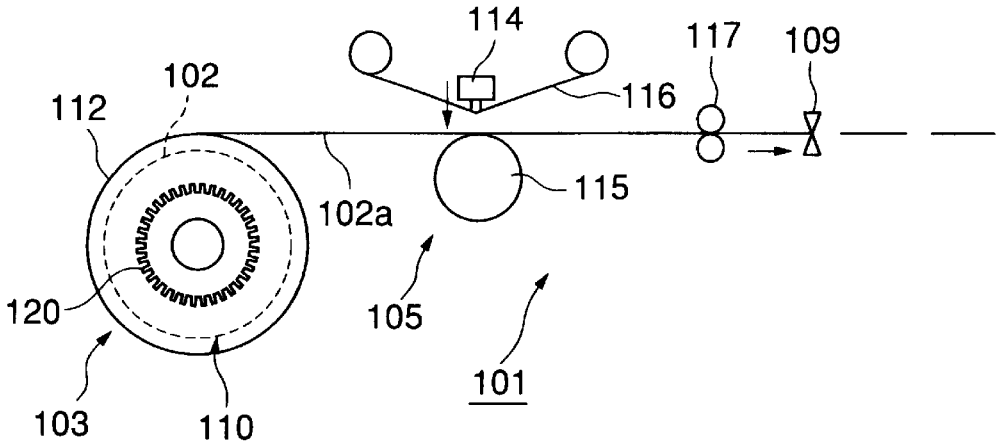
FIG. 10 is a schematic view of a thermal transfer printer in a second embodiment according to the present invention.

FIG. 9 is a side elevation of assistance in explaining an operation for loading a thermal transfer recording web roll 2 into a recording web feed unit 3 of the thermal transfer printer 1 of the present invention. A shaft 13 included in a holding device 4 is inserted in the bore 8 of the coreless thermal transfer recording web roll 2. The thermal transfer recording web roll 2 is fastened to a holding device 4 of a shape conforming to the shape of the bent inner end segment 6*a* of the thermal transfer recording web 2*a* of the thermal transfer recording web roll 2. A flange 30 is attached to one end of the shaft 13 to be inserted in the bore 8 of the thermal transfer recording web roll 2. The thermal transfer recording web roll 2 can be easily located on the shaft 13 by putting one end 31 of the thermal transfer recording web roll 2 to the flange 30. The other end 33 of the shaft 13 is fitted in a flange 29 integrally provided with a gear 28. The other end 32 of the thermal transfer recording web roll 2 comes into contact with the flange 29, so that the thermal transfer recording web roll 2 is held between the flanges 29 and 30 and is protected from abrasion when the same is rotated. The shaft 13 may be fitted in the flange 29 by any method, provided that the method is able to fit the shaft 13 in the flange 29 by axially moving the shaft 13, i.e., laterally moving the shaft 13 as viewed in FIG. 9, and to prevent the shaft 13 from coming off the flange 29 when the gear 28 and the thermal transfer recording web roll 2 are rotated. The flange 29 and the shaft 13 may be provided with pins and dice capable of engaging with the pins, respectively. The thermal transfer recording web roll 2 is thus fixed to the holding device 4, the holding device 4 holding the thermal transfer recording web roll 2 is loaded into the recording web feed unit 3 of the thermal transfer printer 1. During the thermal transfer recording operation, rotative driving force of the thermal transfer printer 1 is transmitted to the gear 28 to rotate the holding device 4 combined with the gear 28 and the thermal transfer recording web roll 2.

The length of the shaft 13 of the holding device 4 employed in the present invention may be adjustable according to the width of the thermal transfer recording web roll 2. A thermal transfer recording web 2*a* having the same width as sheets of a standard trim size, such a standard trim size A3, B3, A4, B4, A5 or B5, is used and the thermal transfer recording web 2*a* is cut into sheets of the same length as sheets of the standard trim size when the thermal transfer recording web 2 is to be cut after being printed into sheets of the standard trim size. Suppose that the thermal transfer recording web 2*a* is to be cut into sheets of the standard trim size A4 after printing, a thermal transfer recording web roll 2 having an axial length equal to the width of the sheet of the standard trim size A4 is used and the thermal transfer recording web 2*a* unwound from the thermal transfer recording web roll 2 is cut into sheets of the same length as the sheets of the standard trim size A4 by the cutting unit 9.

When the length of the shaft 13 needs to be adjustable, the shaft 13 is formed by combining a first member provided with dice, and a second member provided with pins so as to be axially slidable relative to each other. The pins of the second member is fitted in dices of the first member, corresponding to the width of the thermal transfer recording web 2*a*.

According to the present invention, it is important that the holding device 4 holding the inner end segment 6*a* of the thermal transfer recording web 2*a* does not slip relative to the thermal transfer recording web roll 2 or the slip of the holding device 4 relative to the thermal transfer recording web roll 2 does not affect the quality of printed images. Preferably, the thermal transfer recording web 2*a* employed in the present invention has a base web, and a dye-recipient layer formed on the base web and capable of receiving dyes from the color transfer layer of a thermal transfer sheet.

The base web of the thermal transfer recording web 2*a* maybe a paper web, a synthetic paper sheet or a plastic sheet. The dye-recipient layer may be formed directly on the base web or on a primer layer formed on the base web. However, it is preferable to provide the thermal transfer recording web 2*a* with a high print sensitivity and to form a layer having minute voids on the base web to print images of a high image quality not having density irregularity and voids. The layer having minute voids may be a plastic sheet or a synthetic paper sheet.

Layers having minute voids can be formed on various base sheets by various coating methods. A desirable plastic or synthetic paper sheet having minute voids can be formed by preparing a mixture of a polyolefin resin, more specifically, a polypropylene resin, inorganic pigment and/or a polymer incompatible with the polypropylene resin, and a void-formation initiator, spreading the mixture in a film and drawing the film.

The plastic or synthetic paper sheet may be a single layer sheet having minute voids or a multiplayer sheet having minute voids. The multiplayer sheet may have minute voids in all the component layers thereof or may include some component layers not having minute voids. The plastic or synthetic paper sheet may contain a white pigment as a covering agent when necessary. Additives including an optical whitening agent may be added to the plastic or synthetic paper sheet to enhance the whiteness of the plastic or synthetic paper sheet.

The base sheet may be coated with a layer having minute voids by a coating method. Possible plastic resins are polyester resins, urethane resins, polycarbonate resins, acrylic resins, polyvinyl chloride resins, polyvinyl acetate resins or mixtures of some of those resins. The base sheet may be a generally know base sheet. Possible base sheets include paper sheets, such as wood-free paper sheets, coat paper sheets, art paper sheets, cast-coated paper sheets and glassine paper sheet, synthetic paper sheets, nonwoven fabric sheets, and plastic sheets, such as polyethylene terephthalate resin sheets, acrylic resin sheets, polyethylene resin sheets and polypropylene resin sheets.

The base sheet may be a paper sheet, a synthetic paper sheet or a plastic sheet and it is preferable to coat the base sheet with a layer having minute voids. A plastic sheet or a synthetic paper sheet serving as a layer having minute voids may be bonded to the base sheet with an adhesive layer by a known lamination process, such as a dry lamination process, a hot-melt lamination process or an EC lamination process.

The holding device 4 for clamping the inner end segment of the thermal transfer recording web 2*a* of the thermal transfer recording web 2 of the thermal transfer printer 1 of the present invention may be formed of a durable metal, such as aluminum, iron or a stainless steel, or may be formed of a resin, such as a polystyrene resin, vinyl chloride resin, a polycarbonate resin or a polyester resin, by an injection molding process. Preferably, the surface of a part of the holding device 4 to be brought into direct contact with the innermost layer 6 is provided with small ridges or small knobs formed in an optional pattern by a diamond-cutting process, a satin-finishing process or an embossing process. It is preferable to determine embossing depth, i.e., the height of projections of the irregularities, such that the holding device is able to exert a frictional resistance sufficient to prevent the innermost layer 6 from slipping relative to the holding device on the innermost layer 6. For example, the embossing depth is in the range of about 5 to about 500 $\mu$m.

A thermal transfer recording method according to the present invention does not use any core. The part 7 at a distance from the inner end edge 18 of the thermal transfer recording web 2*a* of the innermost layer 6 of the thermal transfer recording web roll 2 is bonded to the second innermost layer of the thermal transfer recording web roll 2, leaving the inner end segment 6*a* in a free state. The holding device 4 is inserted in the bore 8 of the thermal transfer recording web roll 2, the innermost layer 6 is clamped by the holding device 4, the holding device 4 of the thermal transfer printer 1 and the thermal transfer recording web roll 2 are rotated in a body for thermal transfer printing. The rotation of the feed rollers 17 is controlled to feed the thermal transfer recording web 2*a,* and the holding device 4 rotates the thermal transfer recording web roll 2 according to the rotation of the feed rollers 17 to assist the operation for feeding the thermal transfer recording web 2*a*. Therefore, it is preferable that the thermal transfer recording web roll 2 does not slip relative to the holding device 4. However, the thermal transfer recording web roll 2 may slip in some degree relative to the holding device 4, provided that the thermal transfer recording web 2*a* is neither creased nor folded.

When printing a full-color image by a thermal transfer printing operation using three colors, i.e., yellow, magenta and cyan, a yellow dye is transferred from a yellow transfer layer of a thermal transfer sheet 16 to the entire printing area of the thermal transfer recording web 2*a* in a yellow image by heating the yellow transfer layer of the thermal transfer sheet 16 with the thermal head 14, in which the thermal transfer sheet 16 and the thermal transfer recording web 2*a* are moved together in a forward direction (or a backward direction) by a distance corresponding to the length of the print. Then, the leading edge of a magenta layer of the thermal transfer sheet 16 is located under the thermal head 14, and the thermal transfer recording web 2*a* is reversed so that the leading edge of the printing area is located under the thermal head 14.

Then, a magenta dye is transferred from a magenta transfer layer of the thermal transfer sheet 16 to the entire printing area of the thermal transfer recording web 2*a* in a magenta image by heating the magenta transfer layer of the thermal transfer sheet 16 with the thermal head 14. Similarly, a cyan dye is transferred from a cyan transfer layer of the thermal transfer sheet 16 to the entire printing area of the thermal transfer recording web 2*a* in a cyan image by heating the cyan transfer layer of the thermal transfer sheet 16 with the thermal head 14 to complete a full-color printed image. Then, a printed section of the thermal transfer recording web 2*a* is moved in a delivery direction and, when necessary, the printed section is cut in a sheet.

The thermal transfer recording method according to the present invention reciprocates the thermal transfer recording web 2*a* under the thermal head 14; that is the thermal transfer recording web roll 2 is turned in the normal direction and then in the reverse direction for one thermal transfer recording cycle. When images of different colors are superposed to print a full-color image, the image quality of the full-color image is deteriorated unless the images of different colors are registered accurately.

According to the present invention, the innermost layer 6 of the thermal transfer recording web roll 2 is hardly able to slip relative to the holding device 4, and the rotation of the thermal transfer recording web roll 2 can be accurately controlled.

As apparent from the foregoing description, the thermal transfer printer according to the present invention uses the coreless thermal transfer recording web roll, and the innermost layer of the thermal transfer recording web roll excluding the inner end part is fixed to the second innermost layer of the thermal transfer recording web roll. The innermost layer of the thermal transfer recording web roll is held by the holding device, and the thermal transfer recording web roll rotates together with the holding device for thermal transfer printing. Thus, any core is not necessary for holding the thermal transfer recording web roll, the thermal transfer recording web roll can be prepared at a low cost without requiring much time and effort, and an image of an excellent image quality can be formed by thermal transfer printing.

Second Embodiment

FIGS. 10 to 15 are schematic views showing a thermal transfer printer 101 in a second embodiment according to the present invention. The thermal transfer printer 101 has a thermal transfer recording web roll 102 formed by rolling a thermal transfer recording web 102*a,* a recording web feed unit 103 for holding the thermal transfer recording web roll 102 and feeding the thermal transfer recording web 102*a,* two caps (rotative driving mechanisms) 110 for holding the thermal transfer recording web roll 102 in the recording web feed unit 103, each provided with a flange 112, a thermal transfer recording unit 105 capable of printing an image on the thermal transfer recording web 102*a* by a thermal transfer printing method, and a cutting unit 109 for cutting the thermal transfer recording web 102*a* into sheets.

The thermal transfer recording web 102*a* is pulled out from the recording web feed unit 103 by feed rollers 117 in the direction of the arrow, and the leading edge of a recording section of the thermal transfer recording web 102*a* is located at a print starting position. Then, an image is printed on the recording section of the thermal transfer recording web 102*a,* while the feed rollers 117 are reversed to move the thermal transfer recording web 102*a* in the reverse direction, i.e., a direction opposite to the direction of the arrow, and the recording section is taken up on the thermal transfer recording web roll 102. The thermal transfer recording web 102*a* is extended tautly between the caps 110 and the feed rollers 117. The movement of the thermal transfer recording web 102*a* is controlled principally by rotating the feed rollers 117 in the normal and the reverse direction the caps 110 turn the thermal transfer recording web roll 102 according to the rotation of the feed rollers 117 to assist the operation for feeding the thermal transfer recording web 102*a*. Therefore, it is preferable that the thermal transfer recording web roll 102 does not slip relative to the caps 110. However, the thermal transfer recording web roll 102 may slip in some degree relative to the caps 110, provided that the thermal transfer recording web 102*a* is neither creased nor folded.

A thermal transfer sheet 116 is extended so that its back surface can be brought into contact with a thermal head 114. The thermal transfer recording web 102*a* is extended with its recording surface in contact with the surface coated with a transfer layer (the front surface) of the thermal transfer sheet 116. A platen roller 115 is disposed opposite to the thermal head 114 so as to be in contact with the back surface of the thermal transfer recording web 102*a*. When printing an image by thermal transfer recording on the thermal transfer recording web 102*a,* the thermal head 114 is lowered in the direction of the arrow to transfer a color image from the thermal transfer sheet 116 to the thermal transfer recording web 102*a*.

Preferably, two guide members, not shown, are extended along the opposite side edges of the thermal transfer recording web 102*a,* respectively, between the recording web feed unit 103 and the thermal transfer recording unit 105 to prevent the thermal transfer recording web 102*a* from meandering.

Desirably, the distance between the two guide members is adjustable according to the width of the thermal transfer recording web 102*a*. For example, pins and dice which engage with each other are attached to parts of the thermal transfer printer 101 to which the guide members are attached, the plurality of dice are attached to a member, and the member provided with the dice and a member provided with the pins are slid relative to each other. The pins are fitted in the dice located at positions corresponding to the width of the thermal transfer recording web 102*a*. Thus, the thermal transfer recording web 102*a* slides along the guide members, the guide members restrain the thermal transfer recording web 102*a* from lateral movement and hence the thermal transfer recording web 102*a* is prevented from meandering.

The cutting unit 109 of the thermal transfer printer 101 cuts the thermal transfer recording web 102*a* into sheets. The printed thermal transfer recording web 102*a* may be taken up in a printed thermal transfer recording web roll.

Figure 11:
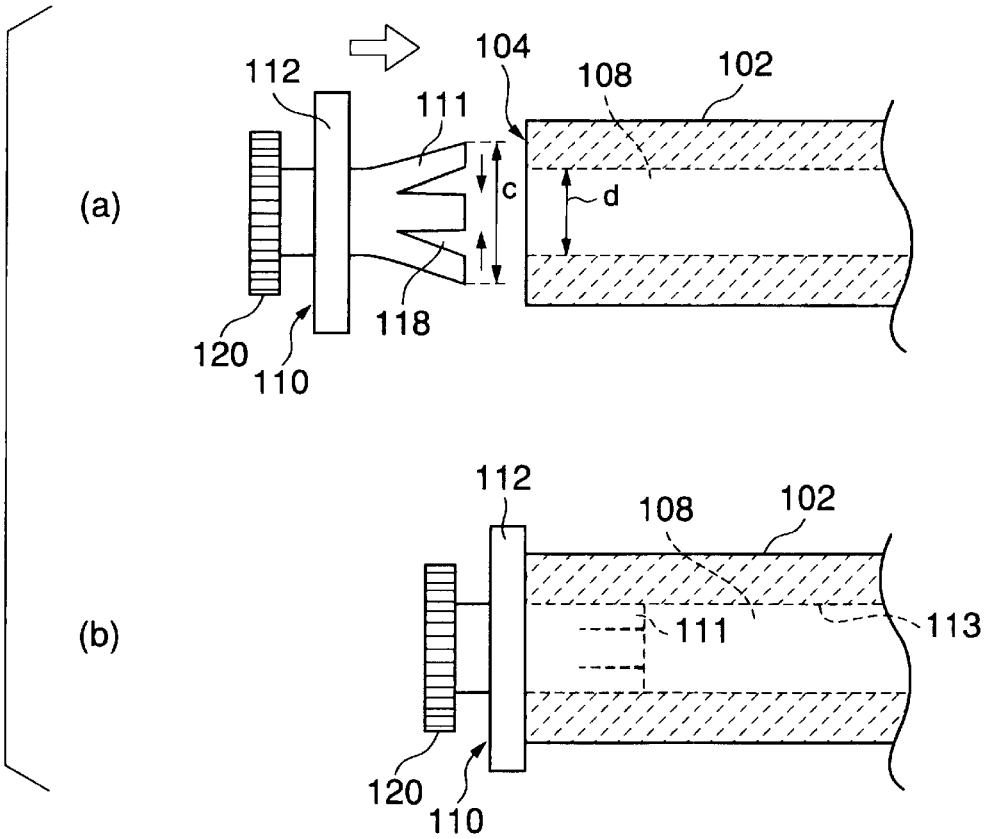
FIGS. 11(*a*) and 11(*b*) are schematic sectional views of assistance in explaining an operation for putting a cap on a thermal transfer recording web roll according to the present invention.

FIGS. 11(*a*) and 11(*b*) are sectional views of assistance in explaining a method of assembling the caps 110 and the thermal transfer recording web roll 102. Referring to FIG. 11(*a*) showing the cap 110 extracted from the bore 108 of the thermal transfer recording web roll 102, the cap 110 has elastic tongues 111 formed by forming slits 118 in a cylindrical plug-shaped part to divide the cylindrical part into a plurality of tongues and bending the tongues so as to curve radially outward. The diameter c of an imaginary circle including the free ends of the elastic tongues 111 in a free state is greater than the diameter d of the bore 108 of the thermal transfer recording web roll 102. The cap 110 has the elastic tongues 111, a flange 112 and a gear 120. The elastic tongues 111 are contracted radially in the directions of the arrows and are inserted in the bore 108 of the thermal transfer recording web roll 102.

When putting the cap 110 on the thermal transfer recording web roll 102, the elastic tongues 111 are contracted radially, the cap 110 is pushed in the direction of the blank arrow to insert the elastic tongues 111 in the bore 108 of the thermal transfer recording web roll 102 such that the inner side surface of the flange 112 is pressed against one end surface 104 of the thermal transfer recording web roll 102 as shown in FIG. 11(*b*).

A cap 110 similar to the cap 110 attached to the end 104 of the thermal transfer recording web roll 102 as shown in FIG. 11(*b*) may be attached to the other end of the thermal transfer recording web roll 102. The cap 110 to be attached to the other end of the thermal transfer recording web roll 102 may be such as having only elastic tongues 111 and a flange 112 and does not need to be provided with a gear.

The elastic tongues 111 are formed of an elastic material. Therefore, the resilience of the radially contracted elastic tongues 111 of the cap 110 causes the elastic tongues 111 to exert pressure on the side surface 113 of the bore 108 as shown in FIG. 11(*b*). The material and the shape of the elastic tongues 111 are determined selectively such that proper friction is produced between the elastic tongues 111 and the thermal transfer recording web roll 102, and the elastic tongues 111 are able to exert proper pressure on the thermal transfer recording web roll 102 so that the cap 110 attached to the thermal transfer recording web roll 102 may not easily come off the thermal transfer recording web roll 102. Thus, the caps 110 and the thermal transfer recording web roll 102 rotate together for thermal transfer printing.

Although it is preferable that the thermal transfer recording web roll 2 may slip in some degree relative to the holding device 4, provided that the thermal transfer recording web 2*a* is not creased.

The thermal transfer web roll 102 does not slip relative to the caps 110. The thermal transfer recording web roll 102 may slip in some degree relative to the caps 110, provided that the slip of the thermal transfer recording web roll 102 relative to the caps 110 does not affect adversely to image quality.

Figure 12:
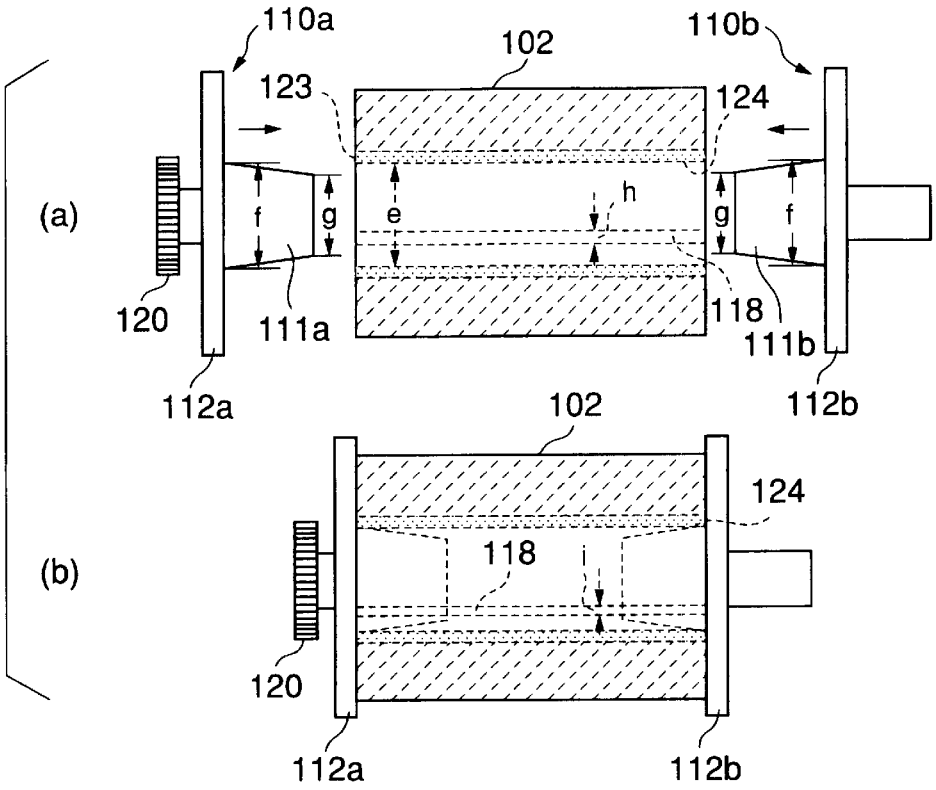
FIGS. 12(*a*) and 12(*b*) are schematic sectional views of assistance in explaining an operation for putting a cap and a hollow member on a thermal transfer recording web roll according to the present invention.
Figure 15:
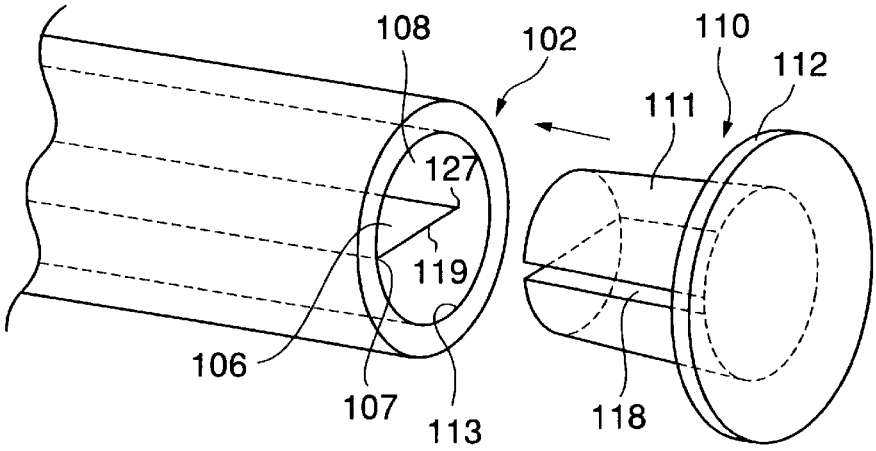
FIG. 15 is a schematic exploded perspective view of assistance in explaining a cap capable of firmly connected to a recording web roll.

FIGS. 12(*a*) and 12(*b*) are schematic sectional views of assistance in explaining work for assembling a thermal transfer recording web roll 102 of a thermal transfer recording web 102*a,* two caps 110*a* and 110*b,* and a bushing 123 provided with a slit 118. In FIG. 12(*a*), the bushing 123 provided with the slit 118 is fitted in the bore 108 of the thermal transfer recording web roll 102, and the plug-shaped parts 111*a* and 111*b* of the two caps 110*a* and 110*b* are not yet fitted in the bushing 123. The outside diameter of the bushing 123 in a free state is slightly greater than the diameter of the bore 108 of the thermal transfer recording web roll 102. The bushing 123 is radially contracted narrowing the slit 118 and is inserted in the bore 108 of the thermal transfer recording web roll 102. Desirably, an inner end segment 119 of the innermost layer 106 of the thermal transfer recording web 102*a* is inserted in the slit 118 of the bushing 123 as shown in FIG. 15 to fix the thermal transfer recording web roll 102 to the bushing 123 firmly. Preferably, the inner end segment 119 is tapered toward its edge to prevent the inner end segment 119 from obstructing the engagement of the two caps 110*a* and 10*b* in the opposite ends of the bushing 123.

The respective plug-shaped parts 111*a* and 111*b* of the caps 110*a* and 110*b* are not provided with any slits. The plug-shaped parts 111*a* and 111*b* are tapered toward their free ends such that the diameter g of the end surfaces thereof is smaller than the inside diameter e of the bushing 123 as fitted in the bore 108 of the thermal transfer recording web roll 102 to facilitate inserting the plug-shaped parts 111*a* and 111*b* of the caps 110*a* and 110*b* in the bushing 123 fitted in the bore 108. The base parts of the plug-shaped parts 111*a* and 111*b* contiguous with the flanges 112*a* and 112*b* is formed in a diameter f slightly greater than the inside diameter 3 of the bushing 123 as fitted in the bore 108 of the thermal transfer recording web roll 102 to fit the plug-shaped parts 111*a* and 111*b* in the bushing 123 in a tight fit.

When the respective plug-shaped parts 111*a* and 111*b* of the caps 110*a* and 110*b* fitted in the bushing 123 fitted in the bore 108 of the thermal transfer recording web roll 102, the plug-shaped parts 111*a* and 111*b* are pressed firmly against the inner circumference 124 of the bushing 123. Consequently, the bushing 123 is expanded in the bore 108, the width h of the slit 118 of the bushing 123 as fitted in the bore 108 is increased to a width i, and the bushing 123 is pressed firmly against the inner surface 113 of the bore 108 of the thermal transfer recording web roll 102. The plug-shaped parts 111*a* and 111*b* of the caps 110*a* and 110*b,* when inserted in the bushing 123 fitted in the bore 108, tend to expand the slit 118. The bushing 123 is formed of an elastic material. Therefore, when the plug-shaped parts 111*a* and 111*b* of the caps 110*a* and 110*b* are extracted from the bushing 123 and the pressure applied to the bushing 123 is removed, the bushing 123 is contracted radially by its own resilience, and the slit 118 recovers its original width h. The caps 110*a* and 110*b,* particularly, the plug-shaped parts 111*a* and 111*b* are formed of a comparatively hard material in order that the dimensions of the same change scarcely when external force is exerted thereon.

Figure 13:
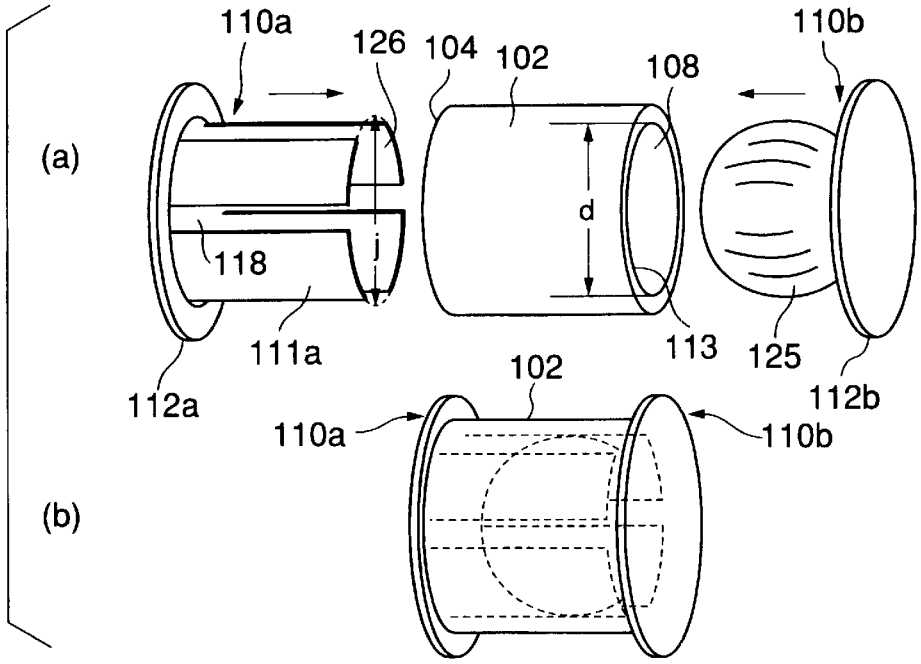
FIGS. 13(*a*) and 13(*b*) are a schematic exploded perspective view and a perspective view, respectively, of assistance in explaining an operation for putting caps on a thermal transfer recording web roll according to the present invention.

FIGS. 13(*a*) and 13(*b*) are schematic sectional views of assistance in explaining work for assembling a thermal transfer recording web roll 102 of a thermal transfer recording web 102*a* according to the present invention, and caps 110*a* and 110*b*. FIG. 13(*a*) shows the two caps 110*a* and 110*b* before being fitted in the bore 108 of the thermal transfer recording web roll 102. The cap 110*a* has a flange 112*a,* and elastic tongues 111*a* spaced by slits 118. The diameter j of a circle including the free ends of the elastic tongues 111*a* of the cap 110*a* maybe either greater than or smaller than the diameter d of the bore 108 of the thermal transfer recording web roll 102. The elastic tongues 111*a* can be radially contracted, so that the elastic tongues 111*a* can be easily inserted in the bore 108 of the thermal transfer recording web roll 102.

The elastic tongues 111*a* of the cap 110*a* is inserted in the bore 108 as deep as the inner side surface of the flange 112*a* is pressed against an end surface 104 of the thermal transfer recording web roll 102. The other cap 110*b* has a flange 112*b* and a plug-shaped part 125. The plug-shaped part 125 of the cap 110*b* is inserted in the other end of the bore 108 of the thermal transfer recording web roll 102 as far as the plug-shaped part 125 is fitted in a space 126 surrounded by the elastic tongues 111*a*. Consequently, the elastic tongues 111*a* of the cap 110*a* are pressed radially outward and are pressed firmly against the side surface 113 of the bore 108 of the thermal transfer recording web roll 102 as shown in FIG. 13(*b*).

Thus, the two caps 110*a* and 110*b* are combined in the bore 108 of the thermal transfer recording web roll 102, the elastic tongues 111*a* of the cap 110*a* are pressed radially outward against the side surface 113 of the bore 108 by the plug-shaped part 125 of the other cap 110*b*. Consequently, the caps 110*a* and 110*b* and the thermal transfer recording web roll 102 are joined together in a body. Gears, not shown, of the thermal transfer printer 101 are engaged with gears, not shown, connected to the caps 110*a* and 110*b* drives the caps 110*a* and 110*b* for rotation together with the thermal transfer recording web roll 102.

Preferably, the end surfaces of the elastic tongues 111*a* of the cap 110*a* are flat to facilitate the insertion of the plug-shaped part 125 of the other cap 110*b* in the space 126 surrounded by the elastic tongues 111*a* of the cap 110*a*.

The elastic tongues 111*a* are formed of an elastic material and are capable of elastically bent radially inward by external force and of recovering its original shape when external force is removed from the elastic tongues 111*a*. The material and the shape of the elastic tongues 111*a* are determined selectively so that proper friction is produced between the elastic tongues 111*a* and the thermal transfer recording web roll 102, and the elastic tongues 111*a* are able to exert proper pressure on the thermal transfer recording web roll 102 so that the caps 110*a* and 110*b* attached to the thermal transfer recording web roll 102 may not easily come off the thermal transfer recording web roll 102. Thus, the caps 110*a* and 110*b* and the thermal transfer recording web roll 102 rotate together for thermal transfer printing.

Figure 14:
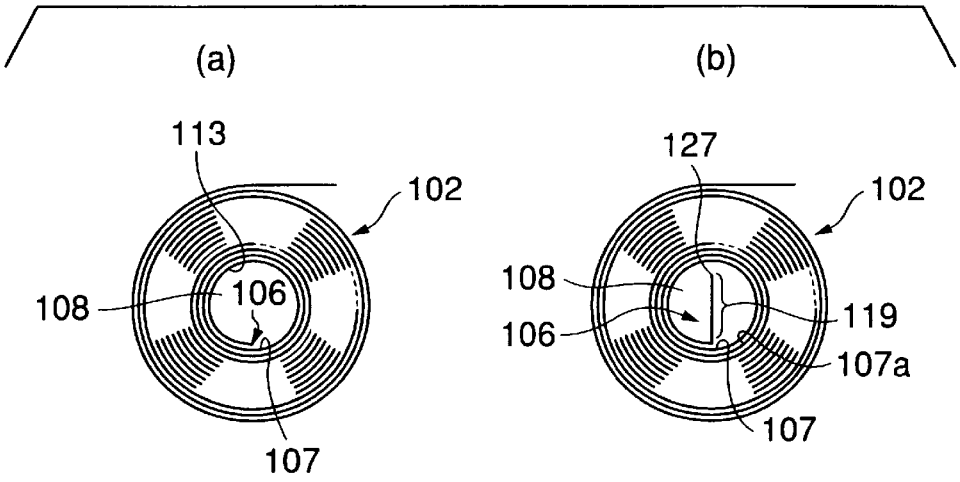
FIGS. 14(*a*) and 14(*b*) are schematic end views of thermal transfer recording web rolls according to the present invention.

FIGS. 14(*a*) and 14(*b*) are schematic end views of thermal transfer recording web rolls 102 according to the present invention. The thermal transfer recording web roll 102 shown in FIG. 14(*a*) is formed by rolling a thermal transfer recording web in a coreless thermal transfer recording web roll 102 having a bore 108, and bonding the innermost layer 106 to a part 107 of the second innermost layer 107*a* of the thermal transfer recording web roll 102. Nothing projects from the inner surface 113 of the bore 108 into the bore 108 of the thermal transfer recording web roll 102 and the inner surface 113 of the bore 108 is cylindrical. The thermal transfer recording web roll 102 shown in FIG. 14(*b*) is formed by rolling a thermal transfer recording web in a coreless roll, and bonding a part 107 of the innermost layer 106 at a distance from the inner end edge 127 of the thermal transfer recording web to the second innermost layer, leaving a free inner end segment 119.

As shown in FIG. 15, the part 107 of the innermost layer 106 at a distance from the inner end edge 127 of the thermal transfer recording web is bonded to the second innermost layer, and the free inner end segment 119 extends from the part 107. Thus, the free inner end segment 119 projects from the inner surface 113 of the bore 108 of the thermal transfer recording web roll 102 into the bore 108. A cap 110 has an elastic plug-shaped part 111 provided with a slit 118 and a flange 112. The elastic plug-shaped part 111 is fitted in the bore 108 of the thermal transfer recording web roll 102 so that the free inner end segment 119 is inserted in the slit 118 of the plug-shaped part 111. The elastic plug-shaped part 111 is tapered as shown in FIG. 12 or is formed in a shape resembling the plug-shaped part 125 of the cap 110*b* shown in FIG. 13(*a*) to fit the plug-shaped part 111 in the bore 108 in close contact with the inner surface 113 of the bore 108 of the thermal transfer recording web roll 102. The flange 112 of the cap 110 is in contact with an end surface of the thermal transfer recording web roll 102 to protect the end surface from abrasion when the thermal transfer recording roll 102 is rotated.

Referring to FIG. 15, when the plug-shaped part 111 of the cap 110 is fitted in the bore 108 of the thermal transfer recording web roll 102, the inner end segment 119 extends between the inner end edge 127 of the thermal transfer recording sheet and the bonded part 107. Preferably, the bonded part 107 is provided with a perforated line or a pressed line so that the inner end segment 119 can be bent along the bonded part 107 so as to extend radially.

According to the present invention, it is important that the elastic plug-shaped part 111 of the cap 110 or the bushing 123 is firmly engaged with the inner surface 113 of the bore 108 of the thermal transfer recording web roll 102 so that the elastic plug-shaped part 111 or the bushing 123 does not slip relative to the thermal transfer recording web roll 102, or slips of the thermal transfer recording web roll 102 relative to the elastic plug-shaped part 111 or the bushing 123 does not affect adversely to image quality. Preferably, the thermal transfer recording web 102*a* employed in the present invention has a base web, and a conventional dye-recipient layer formed on the base web and capable of receiving dyes from the color transfer layer of a thermal transfer sheet.

The cap 110, particularly, the plug-shaped part 111 of the cap 110 and the bushing 123 are formed of an elastic material. The plug-shaped part 111 and the bushing 123 can be elastically contracted when fitting the same in the bore 108 of the thermal transfer recording web roll 102 and are capable of recovering their original shapes, i.e., shapes in a free state. For example, the plug-shaped part 111 of the cap 110, and the bushing 123 can be formed by molding a resin for injection molding, such as an elastic material, such as a polystyrene resin, a vinyl chloride resin, a polycarbonate resin or a polyester resin. When the cap 110 and the bushing 123 are used in combination, it is preferable that the material of the bushing 123 is harder than that of the cap 110, the bushing 123 is more difficult to deform than the cap 110, and the outside diameter of the bushing 123 is increased when the plug-shaped part 111 of the cap 110 is fitted in the bushing 123.

When the caps 110*a* and 110*b* are fixedly held in the bore 108 of the thermal transfer recording web roll 102 and a part of the cap 110*b* is inserted into the other cap 110*a* in the bore 108, it is desirable that the cap 110*a* is formed of a material softer than that of the cap 110*b* and capable of being easily deformable so that the elastic tongues 111*a* of the cap 110*a* can be firmly pressed against the inner surface 113 of the bore 108 of the thermal transfer recording web roll 102.

The thermal transfer recording method of the present invention employs the coreless thermal transfer recording roll 102 formed by rolling the thermal transfer recoding web 102*a* and having the innermost layer 106 bonded to the second innermost layer of the thermal transfer recording web roll 102, and the two caps 110 are fitted in the bore 108 of the thermal transfer recording web roll 102. At least one of the caps 110 is provided with the gear 120, the gear 120 is driven to rotate the cap 110 together with the thermal transfer recording web roll 102.

Preferably, at least one of the caps 110 is provided with the flange 112 to be brought into contact with an end surface of the thermal transfer recording web roll 102.

The elastic tongues 111*a* of the cap 110*a* may be pressed against the inner surface 113 of the bore 108 of the thermal transfer recording web roll 102 by pressing the plug-shaped part 125 of the cap 110*b* into the space 126 surrounded by the elastic tongues 111*a* of the other cap 110*a* in the bore 108.

The bushing 123 may be inserted in the bore 108 of the thermal transfer recording web roll 102, and the plug-shaped parts 111*a* and 111*b* of the two caps 110*a* and 110*b* may be fitted in the opposite ends of the bushing 123, respectively, to press the bushing 123 against the side surface 113 of the bore 108 of the thermal transfer recording web roll 102.

The elastic tongue 111 of the cap 110 and/or the bushing 123 may be provided with a slit, and the inner end segment 119 of the thermal transfer recording web 102*a* of the thermal transfer recording web roll 102 may be inserted in the slit to combine the cap 110 and/or the bushing 123 firmly with the thermal transfer recording web roll 102.

In this thermal transfer recording method, the cap 110, when necessary, the cap 110 and the bushing 123 are driven, for rotation to feed the thermal transfer recording web 102*a*. The cap 110 rotates the thermal transfer recording web roll 102 in synchronism with the rotation of the feed rollers 117 to assist feeding the thermal transfer recording web 102*a*. Although it is therefore preferable that the thermal transfer recording web roll 102 does not slip relative to the cap 110, the thermal transfer recording web roll 102 may slip in some degree relative to the cap 110, provided that the thermal transfer recording web 102*a* is neither creased nor folded.

According to the present invention, the rotation of the thermal transfer recording web roll 102 can be properly controlled by fitting the two caps 110 each having the elastic tongues 111 capable of applying pressure to the inner surface 113 of the bore 108 of the thermal transfer recording web roll 102, and the flange 112 in contact with the end surface of the thermal transfer recording web roll 102 in the opposite ends of the thermal transfer recording web roll 102, respectively.

As apparent form the foregoing description, the thermal transfer printer according to the present invention uses the coreless thermal transfer recording web roll in which the innermost layer is bonded to the second innermost layer. The elastic tongues of the two caps are fitted in the bore of the thermal transfer recording web roll. At least one of the caps is provided with the gear, the gear is driven to rotate the cap and the thermal transfer recording web roll together for thermal transfer printing.

The cap provided with the elastic tongues is inserted in one end of the thermal transfer recording web roll, the plug-shaped part of the other cap is inserted in the other end of the bore of the thermal transfer recording web roll as far as the plug-shaped part is fitted in the space surrounded by the elastic tongues to press the elastic tongues of the cap firmly against the inner surface of the bore of the thermal transfer recording web roll. The bushing is inserted in the bore of the thermal transfer recording web roll, and the plug-shaped parts of the two caps are pressed in the opposite ends of the bushing, respectively, to press the bushing firmly against the inner surface of the bore of the thermal transfer recording web roll.

Thus, the thermal transfer recording method of the present invention does not need any core for supporting the thermal transfer recording web roll, the thermal transfer recording web roll can be prepared at a low cost without requiring much time and effort, and images can be recorded on the thermal transfer recording web in a satisfactory image quality.

Third Embodiment

A third embodiment of the present invention will be described with reference to FIGS. 16 to 20.

Figure 16:
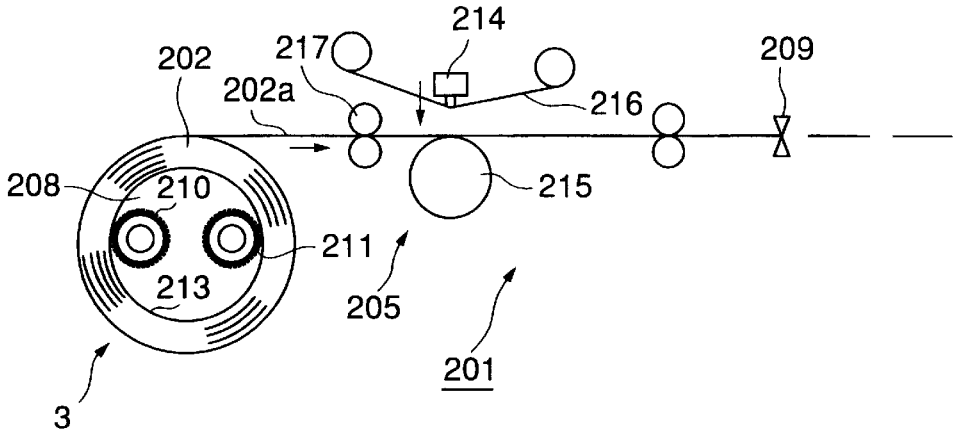
FIG. 16 is a schematic view of a thermal transfer printer in a third embodiment according to the present invention.

Referring to FIG. 16, a thermal transfer printer 201 has a thermal transfer recording web roll 202 formed by rolling a thermal transfer recording web 202*a,* a recording web feed unit 203 holding the thermal transfer recording web roll 202 therein, a plurality of drive rollers (rotative driving mechanism) 210 and 211 inserted in the bore 208 of the thermal transfer recording web roll 202, a thermal transfer recording unit 205, and a cutting unit 209 for cutting the thermal transfer recording web 202*a* into sheets.

The drive rollers 210 and 211 are pressed against the inner surface 213 of the bore 208 of the thermal transfer recording web roll 202. At least the drive roller 210 is driven to rotate the thermal transfer recording web roll 202. The thermal transfer recording unit 205 records images on the thermal transfer recording web 202*a,* and the cutting unit 209 cuts the printed thermal transfer recording web 202*a* into sheets. The thermal transfer recording web 202*a* is pulled out in the direction of the arrow from the thermal transfer recording web roll 202 held in the recording web feed unit 203 by feed rollers 217 such that the leading edge of a section of the thermal transfer recording web 202*a* is located at a print-starting position. Then, the feed rollers 217 are reversed and the thermal transfer recording web roll 202 is turned in a winding direction, i.e., a direction opposite to the direction of the arrow, to move the thermal transfer recording web 202*a* for printing in the direction opposite to the direction of the arrow.

The thermal transfer recording web 202*a* is extended tautly between the recording web feed unit 203 and the feed rollers 217. An operation for feeding and winding the thermal transfer recording web 202*a* is controlled mainly by rotating the feed rollers 217 in the normal or the reverse direction. The drive rollers 210 and 211 rotates the thermal transfer recording web roll 202 in synchronism with the rotation of the feed rollers 217 to assist operations for feeding and winding the thermal transfer recording web 202*a*. Although it is there fore preferable that the thermal transfer recording web roll 202 does not slip relative to the drive rollers 210 and 211, the thermal transfer recording web roll 202 may slip in some degree relative to the drive rollers 210 and 211, provided that the thermal transfer recording web 2022*a* is neither creased nor folded.

The thermal transfer recording unit 205 is provided with a thermal transfer sheet 216 and a thermal head 214. The thermal head 214 is brought into contact with the back surface of the thermal transfer sheet 216. The thermal transfer recording web 202*a* is extended with its recording surface in contact with the surface coated with a transfer layer (the front surface) of the thermal transfer sheet 216. A platen roller 215 is disposed opposite to the thermal head 214 so as to be in contact with the back surface of the thermal transfer recording web 202*a*. When printing an image by thermal transfer recording on the thermal transfer recording web 202*a,* the thermal head 214 is lowered in the direction of the arrow to transfer a color image from the thermal transfer sheet 216 to the thermal transfer recording web 202*a*.

Preferably, guide members, not shown, are extended along the opposite side edges of the thermal transfer recording web 202*a,* respectively, between the recording web feed unit 203 and the thermal transfer recording unit 205 to prevent the thermal transfer recording web 202*a* from meandering.

Desirably, the distance between the guide members is adjustable according to the width of the thermal transfer recording web 202*a*. For example, pins and dice which engage with each other are attached to parts of the thermal transfer printer 201 to which the guide members are attached, the plurality of dice are attached to a member, and the member provided with the dice and a member provided with the pins are slid relative to each other. The pins are fitted in the dice located at positions corresponding to the width of the thermal transfer recording web 202*a*. Thus, the thermal transfer recording web 202*a* slides along the guide members, the guide members restrain the thermal transfer recording web 202*a* from lateral movement and hence the thermal transfer recording web 202*a* is prevented from meandering.

The cutting unit 209 cuts the printed thermal transfer recording web 202*a* into sheets. The printed thermal transfer recording web 202*a* maybe taken up in a printed thermal transfer recording web roll.

Figure 17:
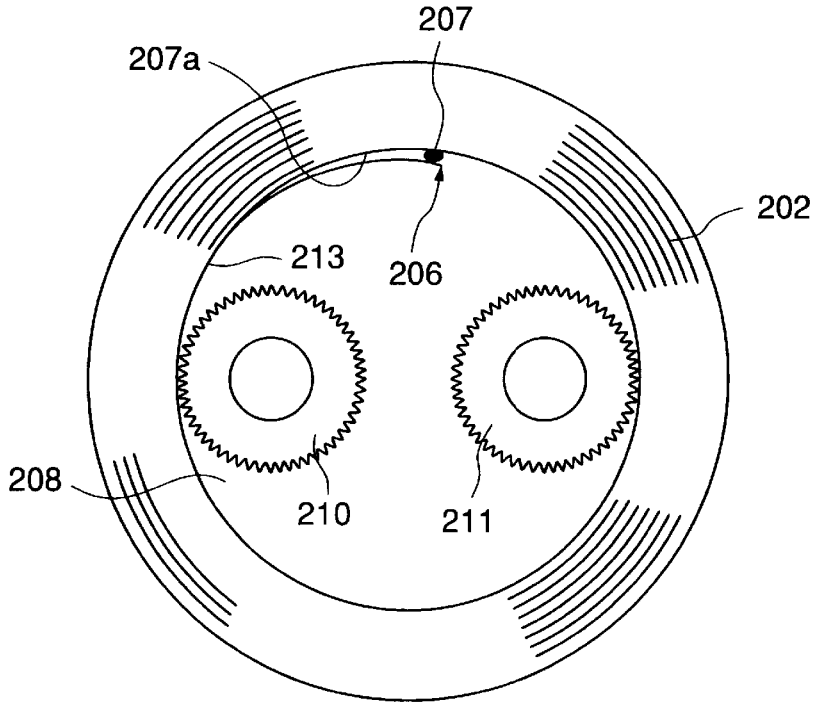
FIG. 17 is an end view of a thermal transfer recording web roll according to the present invention.

FIG. 17 is an end view of the thermal transfer recording web roll 202. As shown in FIG. 17, a thermal transfer recording web 202*a* is rolled in the thermal transfer recording web roll 202. The end edge of the innermost layer 206 is bonded to a part 207 of the second innermost layer 207*a* of the thermal transfer recording web roll 202 with a bonding means, such as a double-coated adhesive tape, a liquid or solid adhesive or a sticky material, or the end edge of the innermost layer 206 may be covered and held on the second innermost layer with an adhesive tape. Adhesive strength between the end edge 207 of the innermost layer 206 and the second innermost layer is adjusted so that the end edge 207 of the innermost layer 206 is separated form the second innermost layer when the innermost layer 206 is pulled by the feed rollers 217. Thus, all the thermal transfer recording web 202*a* of the thermal transfer recording web roll 202 can be used for printing, which is economically efficient and effective in reducing waste.

It is preferable, in view of avoiding adverse effect on thermal transfer recording, that the adhesive strength between the bonding means and the recording surface coated with a dye-recipient layer of the thermal transfer recording web 202*a* is lower than that between the bonding means and the back surface of the thermal transfer recording web 202*a*.

It is still further preferable that the surface of the bonding means to be bonded to the dye-recipient layer of the thermal transfer recording web 202*a* is a tack-free surface which loses tackiness after being separated from the dye-recipient layer and does not make the dye-recipient layer tacky. The tack-free bonding means may be latex of an acrylic resin, a rubber adhesive resin, a wax or a mixture of some of those. Naturally, the dye-recipient layer may be a tack-free layer. If the adhesive strength between the bonding means and the thermal transfer recording web 202*a* is far higher than a peeling force produced by torque applied to the thermal transfer recording web roll 202 by the drive rollers 210 and 211, it is possible to find the exhaustion of the thermal transfer recording web roll 202 from a sharp change in the tension of the thermal transfer recording web 202*a*. Since the end edge of the innermost layer 206 of the thermal transfer recording web 202*a* is bonded to the part 207 of the second innermost layer 207*a* of the thermal transfer recording web roll 202, the thermal transfer recording web roll 202 is a coreless roll having a bore 208.

The two drive rollers 210 and 211 are inserted in the bore 208 of the thermal transfer recording web roll 202 and are pressed against the side surface 213 of the bore 208. At least the drive roller 210 is driven for rotation to rotate the thermal transfer recording web roll 202 for thermal transfer printing.

The two drive rollers 210 and 211 shown in FIG. 17 are driven by a driving mechanism included in the thermal transfer printer 201. A gear, not shown, included in the thermal transfer printer 201 is driven for rotation. Then, the drive rollers 210 and 211 are rotated in the same direction as the gear of the thermal transfer printer 201 to rotate the thermal transfer recording web roll 202. Consequently, the thermal transfer recording web 202*a* is fed for thermal transfer printing.

The drive rollers 210 and 211 may be interlocked by an interlocking member, not shown, so that the feed roller 211 may be rotated by the drive roller 210 when the drive roller 210 is driven for rotation. Thus, only the one drive roller 210 is driven to rotate both the drive rollers 210 and 211.

The circumferences of the drive rollers 210 and 211 pressed against the inner surface 213 of the bore 208 of the thermal transfer recording web roll 202 are provided with small ridges or small knobs to prevent the drive rollers 210 and 211 from easily slipping relative to the thermal transfer recording web roll 202.

According to the present invention, at least one of the drive rollers 210 and 211 pressed against the inner surface 213 of the bore 208 of the thermal transfer recording web roll 202 is driven to rotate the thermal transfer recording web roll 202. The drive roller 211 maybe dragged for rotation by the thermal transfer recording web roll 202 when only the other drive roller 210 is driven for rotation. A slack in a segment of the thermal transfer recording web 202*a* extending between the drive rollers 210 and 211 can be taken up by braking drive roller 211.

The tension of a segment of the thermal transfer recording web 202*a* pulled out from the thermal transfer recording web roll 202 held in the recording web feed unit 203 and extending between the recording web feed unit 203 and the feed rollers 217 can be properly adjusted by driving the drive roller 210 disposed in the bore 208 of the thermal transfer recording web roll 202 at a rotating speed which is relatively low as compared with the rotating speed of the feed rollers 217.

Figure 18:
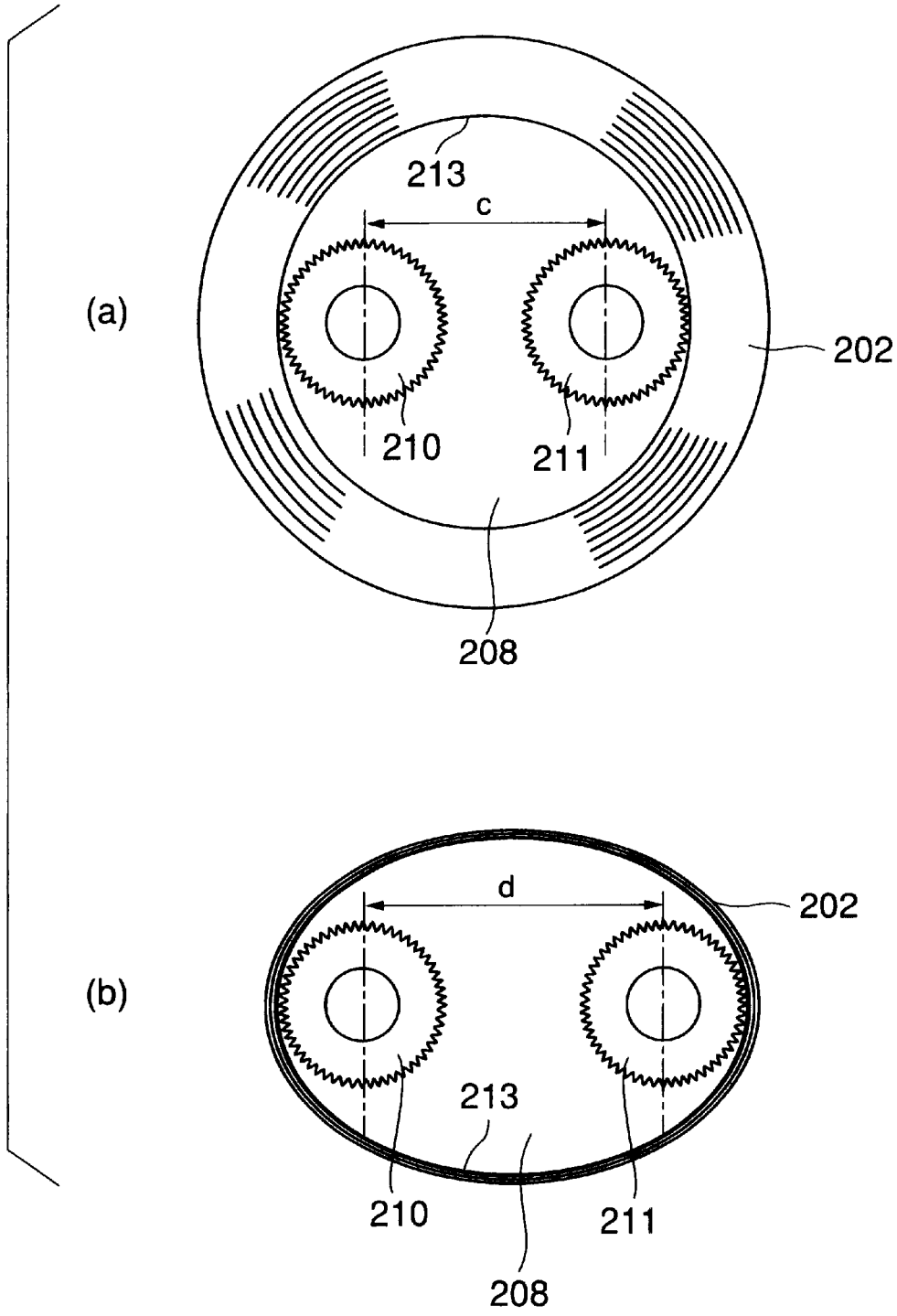
FIGS. 18(*a*) and 18(*b*) are schematic views of an essential part of the thermal transfer printer shown in FIG. 16.

FIGS. 18(*a*) and 18(*b*) are schematic views of an essential part of the thermal transfer printer 201 shown in FIG. 16. As shown in FIG. 18, the center distance between the drive rollers 210 and 211 disposed in the bore 208 of the thermal transfer recording web roll 202 is changed according to the change of the outside diameter of the thermal transfer recording web roll 202. Thus, the thermal transfer recording web roll 202 can be properly rotated by changing the presser applied by the drive rollers 210 and 211 to the inner surface 213 of the bore 208, according to the hardness of the thermal transfer recording web roll 202 that changes as the thermal transfer recording web 202*a* is unwound.

A full thermal transfer recording web roll 202 as shown in FIG. 18(*a*) has a large outside diameter, a long thermal transfer recording web 202*a* and a comparatively high hardness. When the full thermal transfer recording web roll 202 is loaded into the recording web feed unit 203 of the thermal transfer printer 201, the drive rollers 210 and 211 are disposed in the bore 208 of the thermal transfer recording web roll 202 at a center distance c, and the inner surface 213 of the bore 208 in contact with the drive rollers 210 and 211 is cylindrical. Since the thermal transfer recording web roll 202 has a considerably high hardness, the thermal transfer recording web roll 202 is deformed scarcely when the drive rollers 210 and 211 are pressed against the side surface 213 of the bore 208 of the thermal transfer recording web roll 202.

As the thermal transfer printer 201 expends the thermal transfer recording web 202*a* of the thermal transfer recording web roll 202 shown in FIG. 18(*a*), the residual thermal transfer recording web 202*a* decreases and the outside diameter of the thermal transfer recording web roll 202 decreases as shown in FIG. 18(*b*). The hardness of the thermal transfer recording web roll 202 shown in FIG. 18(*b*) is comparatively low and hence the thermal transfer recording web roll 202 originally having the shape of a circular cylinder is deformed in the shape of an elliptic cylinder by the pressure applied thereto by the drive rollers 210 and 211 and hence the center distance between the drive rollers 210 and 211 is increased from c to d.

The pressure applied to the inner surface 213 of the bore 208 of the thermal transfer recording web roll 202 by the drive rollers 210 and 211 can be optionally adjusted by adjusting the center distance between the drive rollers 210 and 211. Thus, the center distance between the drive rollers 210 and 211 is adjusted according to the change of the hardness of the thermal transfer recording web roll 202 as the thermal transfer recording web 202*a* is expended to ensure that the thermal transfer recording web roll 202 can be smoothly rotated.

Although the drive rollers 210 and 211 shown in FIGS. 18(*a*) and 18(*b*) are arranged on a horizontal line, the drive rollers 210 and 211 may be arranged on a vertical line, an oblique line or any suitable arrangement depending on the size and shape of the thermal transfer printer 201 so that the thermal transfer printer 201 is formed in compact construction.

The center distance between the drive rollers 210 and 211 disposed in the bore 208 of the thermal transfer recording web roll 202 is changed according to the change of the outside diameter of the thermal transfer recording web roll 202 so that the pressure applied properly to the inner surface 213 of the bore 208 by the drive rollers 210 and 211 may change properly according to the change of the hardness of the thermal transfer recording web roll 202 from the start of using the thermal transfer recording web 202*a* to the exhaustion of the thermal transfer recording web 202*a* to rotate the thermal transfer recording web roll 202 smoothly. Thus, the drive rollers 210 and 211 can be firmly pressed against the inner surface 213 of the bore 208 of the thermal transfer recording web roll 202 and the pressure applied to the inner surface 213 of the bore 208 can be properly changed according to the change of the length of the thermal transfer recording web 202*a* of the thermal transfer recording web roll 202. Consequently, the thermal transfer recording web roll 202 can be driven for rotation and controlled similarly to the conventional thermal transfer recording web roll formed by winding a thermal transfer recording web on a core.

Figure 19:
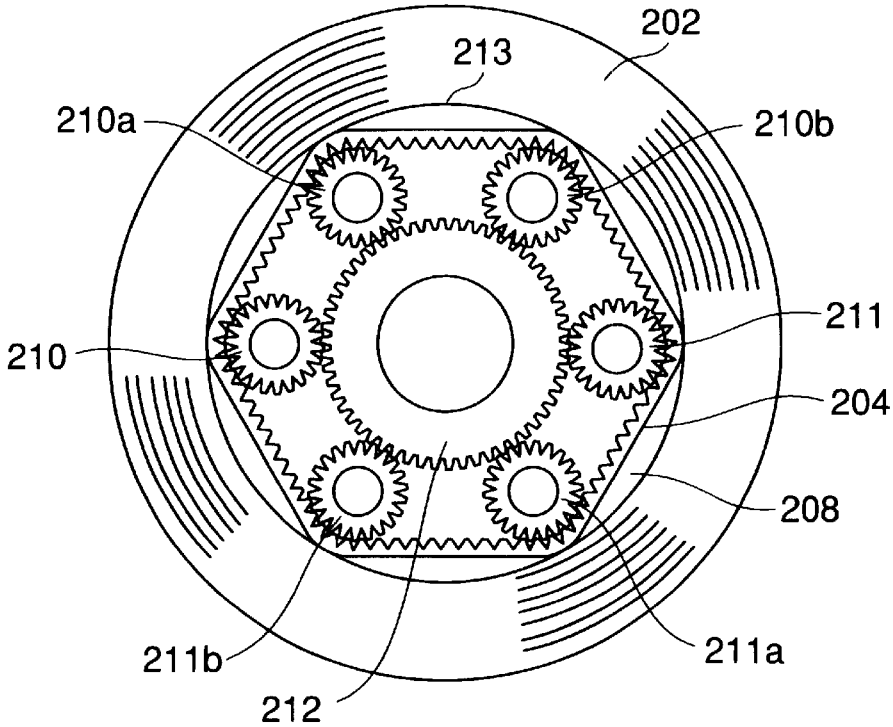
FIG. 19 is a schematic end view of a thermal transfer recording web roll according to the present invention.

FIG. 19 is a view of assistance in explaining another thermal transfer recording web roll 202 according to the present invention. As shown in FIG. 19, six drive rollers 210, 210*a*, 210*b*, 211, 211*a* and 211*b* are inserted in the bore 208 of the thermal transfer recording web roll 202, and an endless belt 204 is extended around and is pressed against the inner surface 213 of the bore 208 by the drive rollers 210, 210*a*, 210*b*, 211, 211*a* and 211*b*. A central drive roller 212 is inserted in the bore 208 coaxially with the thermal transfer recording web roll 202 and is engaged with the six drive rollers 210, 210*a*, 210*b*, 211, 211*a* and 211*b*.

Preferably, the drive rollers 210, 210*a*, 210*b*, 211, 211*a* and 211*b* and the central drive roller 212 are gears. The rotative driving force of the thermal transfer printer 201 is transmitted to the central drive roller 212. The central drive roller 212 drives the endless belt 204 through the drive rollers 210, 210*a*, 210*b*, 211, 211*a* and 211*b* to feed the thermal transfer recording web 202*a* for thermal transfer printing. When the drive rollers 210, 210*a*, 210*b*, 211, 211*a* and 211*b* and the central drive roller 212 are gears, the endless belt 204 is provided in its inside surface with teeth capable of engaging with those of the drive rollers 210, 210*a*, 210*b*, 211, 211*a* and 211*b* and the central drive roller 212.

Although the single endless belt 204 is disposed in the bore 208 of the thermal transfer recording web roll 202 shown in FIG. 19, a plurality of sets each of an endless belt and drive rollers for driving the endless belt may be arranged in the bore 208 of the thermal transfer recording web roll 202 along the axis of the thermal transfer recording web roll 202.

Figure 20:
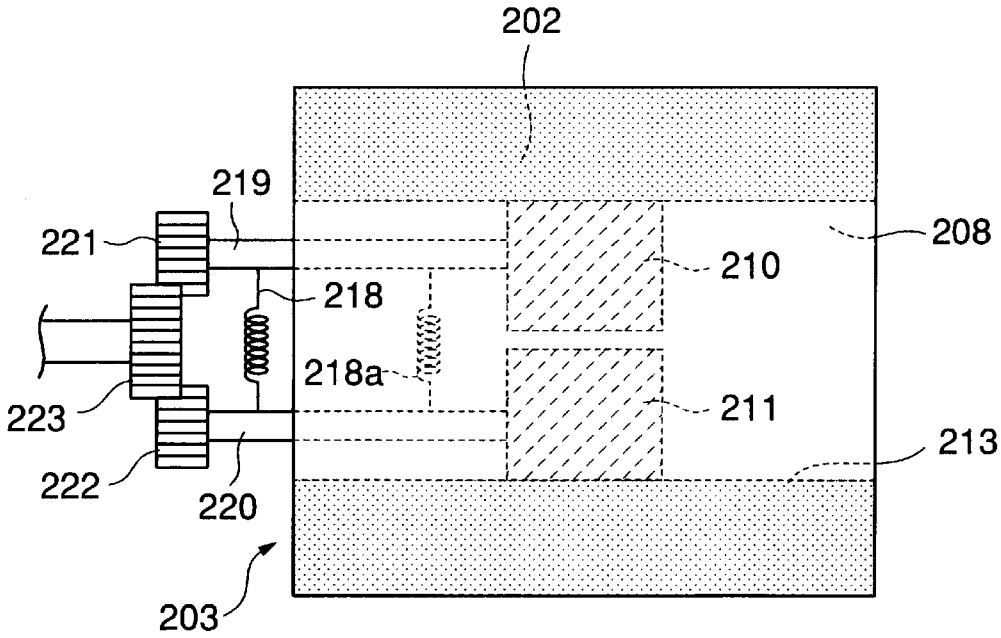
FIG. 20 is a schematic sectional view of a part of a thermal transfer printer according to the present invention.

FIG. 20 is a schematic sectional view of the recording web feed unit 203 of the thermal transfer printer 201 of the present invention and the associated parts. Drive rollers 210 and 211 are disposed in the bore 208 of the thermal transfer recording web roll 202 and are pressed against the side surface 213 of the bore 208.

The drive rollers 210 and 211 have shafts 219 and 220, and gears 221 and 222 are fixedly mounted on the shafts 219 and 220, respectively. Compression springs 218 and 218*a* are extended between the shafts 219 and 220. When inserting the drive rollers 210 and 211 in the bore 208 of the thermal transfer recording web roll 202, force P is applied to the shafts 219 and 220 to reduce the center distance between the shafts 219 and 220 against the resilience of the compression springs 218 and 218*a*. The force P is removed from the shafts 219 and 220 after disposing the drive rollers 210 and 211 at predetermined positions in the bore 208. Then, the drive rollers 210 and 211 are pressed against the inner surface 213 of the bore 208 of the thermal transfer recording web roll 202 by the resilience of the compression springs 218 and 218*a*.

Although the two compression springs 218 and 218*a* are employed in the arrangement shown in FIG. 20, any suitable number of springs may be extended between any suitable positions on the shafts 219 and 220 to apply a proper pressure to the inner surface 213 of the bore 208 of the thermal transfer recording web roll 202 by the drive rollers 210 and 211 and to enable a proper force to reduce the center distance between the shafts 219 and 220 when inserting the drive rollers 210 and 211 in the bore 208.

The gears 221 and 222 are engaged with a drive gear 223 which is driven by a rotative driving force of the thermal transfer printer 201. The drive gear 223 drives the gears 221 and 222 for rotation to rotate the drive rollers 210 and 211. The circumferences provided with small ridges or small knobs of the drive rollers 210 and 211 are pressed against the side surface 213 of the bore 208 of the thermal transfer recording web roll 202 to drive the thermal transfer recording web roll 202 for rotation.

Thus, the controlled rotative driving force of the thermal transfer printer 201 is transmitted to the thermal transfer recording web roll 202 to rotate the thermal transfer recording web roll 202.

Although not shown in FIG. 20, a stopper may be put in contact with an end surface of the thermal transfer recording web roll 202 on the side of the gears 221 and 222, or a stopper may be disposed in the recording web feed unit 203 of the thermal transfer printer 201 so as to be in contact with an end surface of the thermal transfer recording web roll 202 as held in the recording web feed unit 203.

The position of the stopper is variable according to the length of the thermal transfer recording web roll 202. The stopper and a member, such as a shaft to be used in combination with the stopper, are provided with a pin and plurality of dice, respectively. The pin is engaged with the die disposed at a position corresponding to the length of the thermal transfer recording web roll 202 so that the stopper comes into contact with one end surface of the thermal transfer recording web roll 202. Two stoppers may be brought into contact with the opposite end surfaces of the thermal transfer recording web roll 202 to prevent the abrasion of the opposite end surfaces of the thermal transfer recording web roll 202 when the thermal transfer recording web roll 202 is rotated.

Although the thermal transfer recording web rolls 202 shown in FIGS. 16, 19 and 20 are provided with the two drive rollers, the seven drive rollers (the six of those rollers are used to press the endless belt 204 against the side surface 213 of the bore 208), and the two drive rollers, respectively, the thermal transfer recording web roll according to the present invention may be provided with any suitable number of drive rollers and any suitable number of endless belts.

According to the present invention, it is important that the drive rolls 210 and 211 or the endless belt 204 do not slip relative to the side surface 213 of the bore 208 of the thermal transfer recording web roll 202 or the slip of the same relative to the side surface 213 of the bore 208 of the thermal transfer recording web roll 202 does not affect the quality of printed images. Preferably, the thermal transfer recording web 202*a* employed in the present invention has a base web, and a known dye-recipient layer formed on the base web and capable of receiving dyes from the color transfer layer of a thermal transfer sheet.

The drive rollers 210 and 211 and the like, and the endless belt 204 maybe formed of the same material. Possible materials for forming the drive rollers 210, 211 and the endless belt 204 are, for example, hydrogenated polybutadiene rubbers, butyl rubbers, isoprene rubbers, chloroprene rubbers, acrylic elastomers, urethane rubbers, silicone rubbers, fluororubbers, ethylene-propylene terpolymers (EPDMs), styrene-butadiene rubbers (SBRs), acrylonitrile butadiene rubbers (NBR) and a blend of some of these materials. The rubber material may be a thermoplastic elastomer. The urethane rubbers include polyester- and polyether-type thermoplastic polyurethane elastomers produced through polyaddition reaction between diisocyanate and a polyol.

Preferably, the surfaces to be brought into direct contact with the inner surface 213 of the bore 208 of the thermal transfer recording web roll 202 of the drive rollers 210, 211 and the other drive rollers, and the endless belt 204 are provided with small ridges or small knobs formed in an optional pattern by a diamond-cutting process, a satin-finishing process or an embossing process. It is preferable to determine embossing depth, i.e., the height of projections of the small ridges or the small knobs, so that the endless belt 204 is able to exert a frictional resistance sufficient to prevent the thermal transfer recording web roll 202 from slipping relative to the endless belt 204. For example, the embossing depth is in the range of about 5 to about 500 $\mu$m.

A thermal transfer recording method according to the present invention does not use any core. The innermost layer 206 of the thermal transfer recording web roll 202 is bonded to the part 207 of the second innermost layer 207*a* of the same, the drive rollers 210 and 211 are inserted in the bore 208 of the thermal transfer recording web roll 202, and the center distance between the drive rollers 210 and 211 is adjusted optionally to press the drive rollers 210 and 211 against the side surface 213 of the bore 208. At least the drive roller 210 is driven for rotation to rotate the thermal transfer recording web roll 202 for thermal transfer printing. The rotation of the feed rollers 217 is controlled to feed the thermal transfer recording web 202*a,* and the drive rollers 210 and 211 and the central drive roller 212 are rotated in synchronism with the rotation of the feed rollers 217 to rotate the thermal transfer recording web roll 202 according to the rotation of the feed rollers 217 to assist the operation for feeding the thermal transfer recording web 202*a.* Therefore, it is preferable that the thermal transfer recording web roll 202 does not slip relative to the drive rollers 210 and 211. However, the thermal transfer recording web roll 2 may slip in some degree relative to the drive rollers 210 and 211, provided that the thermal transfer recording web 2*a* is neither creased nor folded.

According to the present invention, the drive rollers 210, 211 and the other drive rollers are set in contact with the side surface 213 of the bore 208 of the thermal transfer recording web roll 202 and, when necessary, the endless belt 204 is interposed between the side surface 213 of the bore 208 and the drive rollers 210, 211 and the other drive rollers, so that the thermal transfer recording web roll 202 is hardly able to slip relative to the drive rollers 210, 211 and the other drive rollers and the rotation of the thermal transfer recording web roll 202 can be surely controlled.

As apparent from the foregoing description, the thermal transfer printer according to the present invention uses the coreless thermal transfer recording web roll, and the innermost layer of the thermal transfer recording web roll is fixed to the second innermost layer of the thermal transfer recording web roll. The drive rollers are inserted in the bore of the thermal transfer recording web roll, the center distance between the drive rollers is adjusted optionally to press the drive rollers against the side surface of the bore. At least one of the drive rollers is driven for rotation to rotate the thermal transfer recording web roll for thermal transfer printing. Thus, any core is not necessary for holding the thermal transfer recording web roll, the thermal transfer recording web roll can be prepared at a low cost without requiring much time and effort, and an image of an excellent image quality can be formed by thermal transfer printing.

Fourth Embodiment

Figure 21:
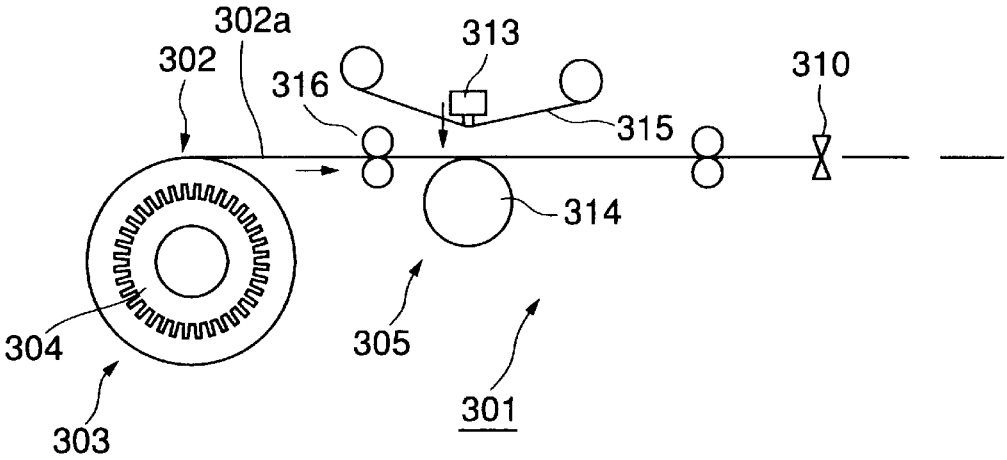
FIG. 21 is a schematic view of a thermal transfer printer in a fourth embodiment according to the present invention.

FIGS. 21 to 25 are schematic views of a fourth embodiment of the present invention. Referring to FIG. 21, a thermal transfer printer 301 has a thermal transfer recording web roll 302 formed by rolling a thermal transfer recording web 302*a,* a recording web feed unit 303 provided with a rotative driving device (rotative driving mechanism) 304 for rotating the thermal transfer recording web roll 302, a thermal transfer recording unit 305, and a cutting unit 310 for cutting the thermal transfer recording web 302*a* into sheets.

The thermal transfer recording web 302*a* is pulled out from the recording web feed unit 303 by feed rollers 316 in the direction of the arrow such that the leading edge of a section of the thermal transfer recording web 302*a* is located at a print-starting position. Then, the feed rollers 316 are reversed and the thermal transfer recording web roll 302 is turned in a winding direction to move the thermal transfer recording web 302*a* for printing in a direction opposite to the direction of the arrow. The thermal transfer recording web 302*a* is extended tautly between the rotative driving device 304 and the feed rollers 316. An operation for feeding and winding the thermal transfer recording web 302*a* is controlled mainly by rotating the feed rollers 316 in the normal or the reverse direction. The rotative driving device 304 is interlocked with the feed rollers 316 so as to rotate the thermal transfer recording web roll 302 according to the rotation of the feed rollers 316 to unwind or wind the thermal transfer recording web 302*a* subordinately to the operation of the feed rollers 316. Although it is preferable that the thermal transfer recording web roll 302 does not slip relative to the rotative driving device 304, the thermal transfer recording web roll 302 may slip in some degree relative to the rotative driving device 304, provided that the thermal transfer recording web 302*a* is neither folded nor creased.

The thermal transfer recording unit 305 is provided with a thermal transfer sheet 315 and a thermal head 313. The thermal head 313 is brought into contact with the back surface of the thermal transfer sheet 315. The thermal transfer recording web 302*a* is extended with its recording surface in contact with the surface coated with a transfer layer (the front surface) of the thermal transfer sheet 315. A platen roller 314 is disposed opposite to the thermal head 313 so as to be in contact with the back surface of the thermal transfer recording web 302*a*. When printing an image by thermal transfer recording on the thermal transfer recording web 302*a,* the thermal head 313 is lowered in the direction of the arrow to transfer a color image from the thermal transfer sheet 315 to the thermal transfer recording web 302*a*.

Preferably, two guide members, not shown, are extended along the opposite side edges of the thermal transfer recording web 302*a,* respectively, between the recording web feed unit 303 and the thermal transfer recording unit 305 to prevent the thermal transfer recording web 302*a* from meandering.

Desirably, the distance between the two guide members is adjustable according to the width of the thermal transfer recording web 302*a*. For example, pins and dice which engage with each other are attached to parts of the thermal transfer printer 301 to which the guide members are attached, the plurality of dice are attached to a member, and the member provided with the dice and a member provided with the pins are slid relative to each other. The pins are fitted in the dice located at positions corresponding to the width of the thermal transfer recording web 302*a*. Thus, the thermal transfer recording web 302*a* slides along the guide members, the guide members restrain the thermal transfer recording web 302*a* from lateral movement and hence the thermal transfer recording web 302*a* is prevented from meandering.

The cutting unit 310 of the thermal transfer printer 301 cuts the thermal transfer recording web 302*a* into sheets. The printed thermal transfer recording web 302*a* may be taken up in a printed thermal transfer recording web roll.

Figure 22:
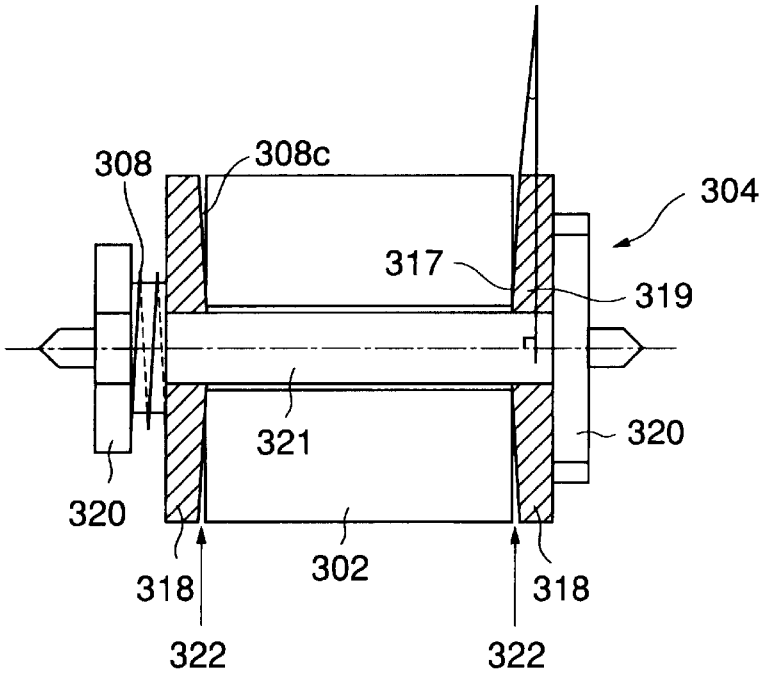
FIG. 22 is a schematic sectional view of a part of the thermal transfer printer shown in FIG. 21.

FIG. 22 is a schematic, fragmentary sectional view of the thermal transfer printer of the present invention, showing the assembly of the thermal transfer recording web roll 302 held in the recording web feed unit 303, and the rotative driving device 304. The rotative driving device 304 includes a pair of disks (rotative driving members) 318 each having a tapered side surface 318*c*. An inner peripheral part 319 of each disk 318 of the rotative driving device 304 is pressed against an inner peripheral part 317 of each end surface of the thermal transfer recording web roll 302. The thermal transfer printer 301 drives the rotative driving device 304 to rotate the disks 318 in the normal or the reverse direction for thermal transfer printing, and the thermal transfer recording web roll 302 is rotated accordingly. A compression spring 308 is compressed between one of the disks 318 and a flange 320 disposed on the outer side of the disk 318 to press the disks 318 against the opposite end surfaces 322 of the thermal transfer recording web roll 302.

Preferably, the taper angle of the tapered side surface 318c, to be pressed against the end surface of the thermal transfer recording web roll 302, of each disk 318 is in the range of about 5° to about 20°. The side surface 318*c* of each disk 318 does not necessarily need to be tapered; the inner side surface maybe a flat surface parallel to the corresponding end surface of the thermal transfer recording web roll 302. The side surfaces 318*c* of the disks 318 of the rotative driving device 304 do not need necessarily to be pressed against the end surfaces of the thermal transfer recording web roll 302; a shaft 321 included in the rotative driving device 304 may be provided with externally threaded parts, the disks 318 and the flanges 320 may be provided with internally threaded holes, and the disks 318 and the flanges 302 may be screwed on the externally threaded parts of the shaft 321, respectively.

Figure 24:
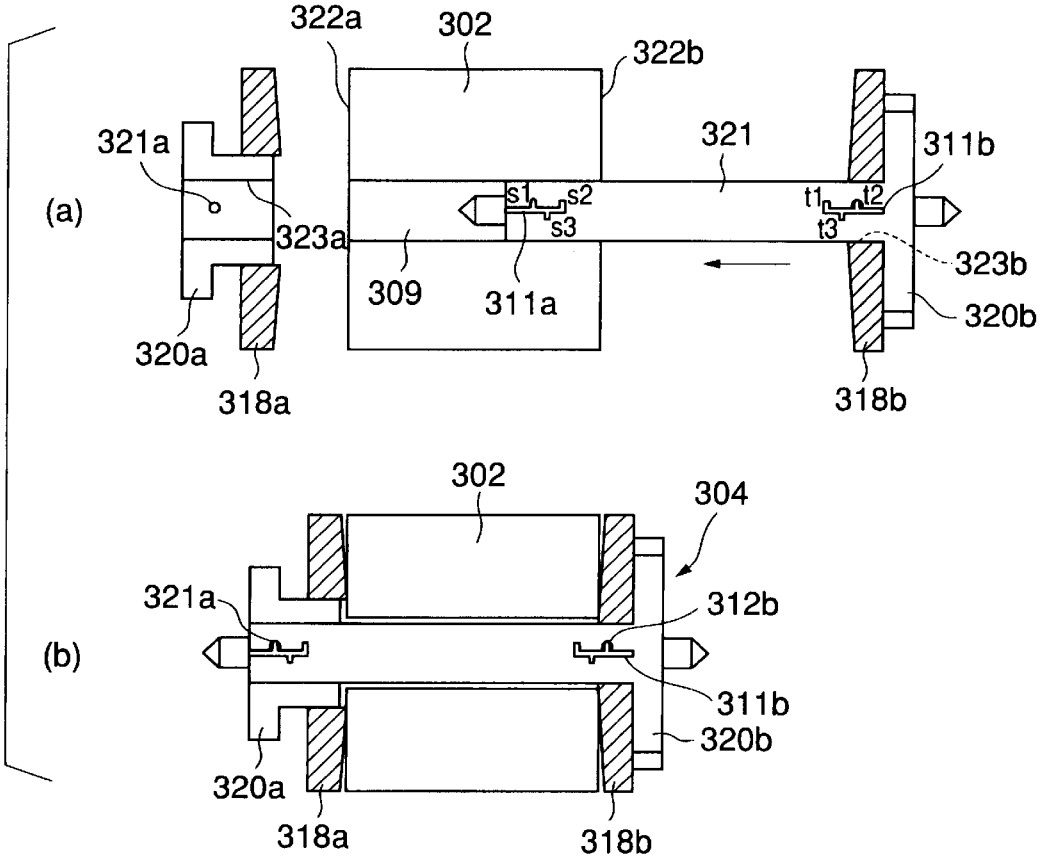
FIGS. 24(*a*) and 24(*b*) are schematic sectional views of a rotative driving device for holding a thermal transfer recording web roll by the opposite ends thereof.

FIGS. 24(*a*) and 24(*b*) are sectional views of a rotative driving device having parts pressed against the end surfaces of the thermal transfer recording web roll according to the present invention. Referring to FIG. 24(*a*), a disk 318*b* is put on a shaft 321 provided with a flange 320*b* so as to rest on the flange 320*b*. The shaft 321 is inserted in the bore 309 of the thermal transfer recording web roll 302 through an open end of the bore 309 on the side of an end surface 322*b* of the thermal transfer recording web roll 302 and is pushed in the direction of the arrow so that an end part thereof project from the other open end, on the side of the other end surface 322*a* of the thermal transfer recording web roll 302, of the bore 309. The assembly of a disk 318*a* and a flange 320*a* having a bore 323*a* is put on the end part of the shaft 321 projecting from the end surface 322*a*. Thus, the disks 318*a* and 318*b* are pressed against the opposite end surfaces 322*a* and 322*b* of the thermal transfer recording web roll 302, respectively, as shown in FIG. 24(*b*).

The thermal transfer recording web roll 302 and the rotative driving device 304 are engaged frictionally so as to rotate in a body for thermal transfer printing. Although it is preferable that the thermal transfer web roll 302 does not slip relative to the rotative driving device 304, the thermal transfer recording web roll 302 may slip in some degree relative to the rotative driving device 304, provided that the slip of the thermal transfer recording web roll 302 relative to the rotative driving device 304 does not affect adversely to image quality.

Figure 23:
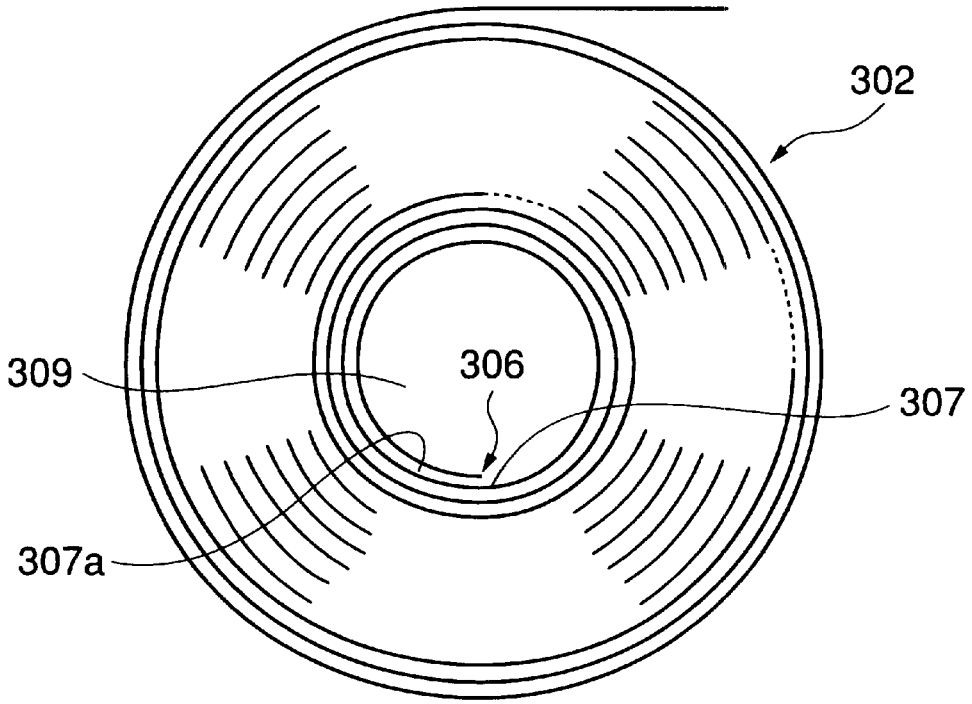
FIG. 23 is a schematic end view of a thermal transfer recording web roll according to the present invention.

FIG. 23 is an end view of the thermal transfer recording web roll 302. As shown in FIG. 23, the thermal transfer recording web roll 302 formed by rolling a thermal transfer recording web. The end edge of the innermost layer 306 is bonded to a part 307 of the second innermost layer 307*a* of the thermal transfer recording web roll 302 with a bonding means, such as a double-coated adhesive tape or a liquid or solid adhesive, or the end edge of the innermost layer 306 may be covered and held on the second innermost layer with an adhesive tape. The thermal transfer recording web roll 302 is a coreless roll having a bore 309. The thermal transfer recording web roll 302 is held between the disks 318 of the rotative driving device 304 shown in FIG. 22. The disks 318 are pressed against the opposite end surfaces of the thermal transfer recording web roll 302, respectively, and rotate together with the thermal transfer recording web roll 302 for thermal transfer printing.

Figure 25:
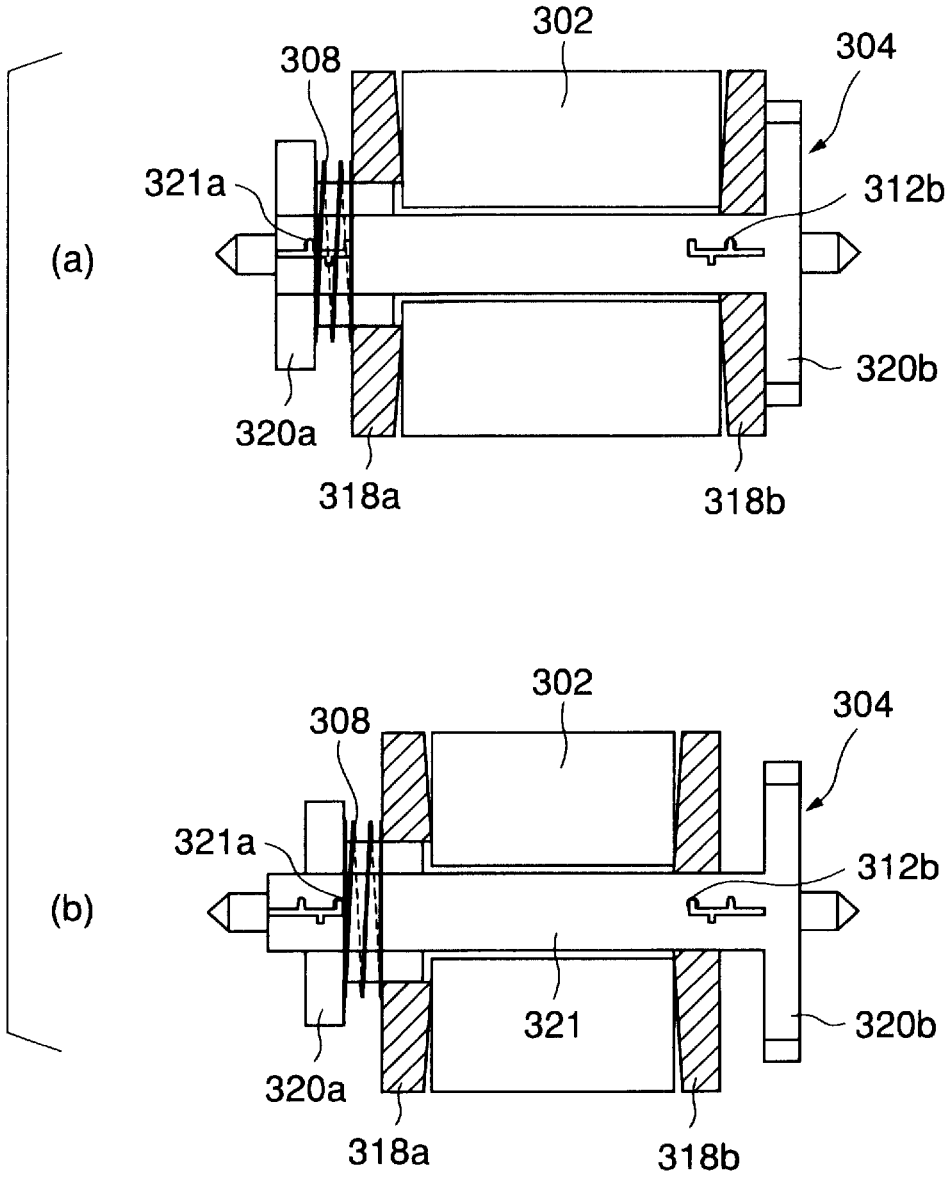
FIGS. 25(*a*) and 25(*b*) are schematic sectional views of a rotative driving device including a center shaft of a variable length.

As shown in FIGS. 24 and 25, the distance between the respective side surfaces 318*c* of the disks 318*a* and 318*b* can be changed according to the length of the thermal transfer recording web roll 302, i.e., the width of the thermal transfer recording web 302*a*. The printed thermal transfer recording web 302*a* is cut into sheets of a standard trim size, such a standard trim size A3, B3, A4, B4, A5 or B5. In most cases, the thermal transfer recording web 302*a* of the thermal transfer recording web roll 302 has a width equal to the that of a sheet of a selected standard trim size, such as a standard trim size A4, obtained by cutting the thermal transfer recording web 302*a,* and the printed thermal transfer recording web 302*a* is cut in a length equal to that of the sheet of the selected standard trim size.

When adjusting the distance between the disks 318 mounted on the shaft 321 of the rotative driving device 304, i.e., the working length of the shaft 321, to combine a thermal transfer recording web roll 302 having a comparatively long length, a pin 312*b* projecting from the side surface of the bore 323*b* of the disk 318*b* is engaged in a notch t2 formed in a groove 311*b* formed in the shaft 321 (FIGS. 24(*b*) and 25(*a*)) to determine the position of the flange 318*b* on the shaft 321. Subsequently, a pin 312*a* projecting from the side surface of the bore 323*a* of the flange 320*a* is engaged in a notch s1 formed in a groove 311*a* formed in the shaft 321 (FIGS. 24(*b*) and 25(*a*)) to determine the position of the flange 320*a* on the shaft 321. The compression spring 308 compressed between the flange 320*a* and the disk 318*a* presses the disk 318*a* against the end surface of the thermal transfer recording web roll 302. Thus, the thermal transfer recording web roll 302 having a comparatively long length is combined with the rotative driving device 304.

When adjusting the distance between the disks 318, i.e., the working length of the shaft 321, to combine a thermal transfer recording web roll 302 having a comparatively short length, the pin 312*b* projecting from the side surface of the bore 323*b* of the disk 318*b* is engaged in a notch t1 formed in the groove 311*b* formed in the shaft 321 as shown in FIG. 25(*b*) to determine the position of the flange 318*b* on the shaft 321. Subsequently, the pin 312*a* projecting from the side surface of the bore 323*a* of the flange 320*a* is engaged in a notch s2 formed in the groove 311*a* formed in the shaft 321 to determine the position of the flange 320*a* on the shaft 321. The compression spring 308 compressed between the flange 320*a* and the disk 318*a* presses the disk 318*a* against the end surface of the thermal transfer recording web roll 302.

Preferably, symbols indicating standard trim sizes, such as A4 and A5, are marked in the surface of the shaft 321 at positions near the notches for the standard trim sizes, respectively, to facilitate operations for adjusting the distance between the disks 318*a* and 318*b*.

The rotative driving devices shown in FIGS. 22, 24 and 25 press the disks 308 against the end surfaces of the thermal transfer recording web roll 302. The thermal transfer recording web roll 302 and the rotative driving device 304 can be securely joined together by fitting the shaft 321 in the bore 309 of the thermal transfer recording web roll 302 so that the surface of the shaft 321 is in close contact with the side surface of the bore 309. When thus combining the rotative driving device 304 and the thermal transfer recording web roll 302, it is preferable to form a part, on the side of the disk 318*b*, of the shaft 321 in a diameter greater than that of other part of the same to increase the pressure to be applied to the side surface of the bore 309 by the shaft 321.

According to the present invention, it is important that the rotative driving device 304 does not slip relative to the thermal transfer recording web roll 302 or the slip of the holding device 304 relative to the thermal transfer recording web roll 302 does not affect the quality of printed images. Preferably, the thermal transfer recording web 302*a* employed in the present invention has a base web, and a dye-recipient layer formed on the base web and capable of receiving dyes from the color transfer layer of a thermal transfer sheet.

The disks 318, 318*a* and 318*b* of the rotative driving device 304 of the thermal transfer printer according to the present invention may be formed of a durable metal, such as aluminum, iron or a stainless steel or may be formed of a resin, such as a polystyrene resin, a vinyl chloride resin, a polycarbonate resin or a polyester resin, by injection molding. Preferably, the surfaces of the disks 318, 318*a* and 318*b* to be brought in to direct contact with the thermal transfer recording web roll 302 are provided with small ridges or small knobs formed in an optional pattern by a diamond-cutting process, a satin-finishing process or an embossing process. It is preferable to determine embossing depth, i.e., the height of projections of the irregularities, such that the holding device is able to exert a frictional resistance sufficient to prevent the thermal transfer recording web roll 302 from slipping relative to the disks 318, 318*a* and 318*b*. For example, the embossing depth is in the range of about 5 to about 500 $\mu$m.

A thermal transfer recording method according to the present invention does not use any core. The innermost layer 306 of the thermal transfer recording web roll 302 is bonded to the second innermost layer of the thermal transfer recording web roll 302, the thermal transfer recording web roll 302 is held by the rotative driving device 304, and the holding device 304 and the thermal transfer recording web roll 302 are rotated in a body for thermal transfer printing. The rotation of the feed rollers 316 is controlled to feed the thermal transfer recording web 302*a*, and the rotative driving device 304 rotates the thermal transfer recording web roll 302 according to the rotation of the feed rollers 316 to assist the operation for feeding the thermal transfer recording web 302*a*. Therefore, it is preferable that the thermal transfer recording web roll 302 does not slip relative to the rotative driving device 304. However, the thermal transfer recording web roll 302 may slip in some degree relative to the rotative driving device 304, provided that the thermal transfer recording web 302*a* is neither creased nor folded.

According to the present invention, the thermal transfer recording web roll 302 and the rotative driving device 304 are hardly able to slip relative to each other, and the rotation of the thermal transfer recording web roll 302 can be surely controlled.

As apparent form the foregoing description, the thermal transfer printer according to the present invention uses the coreless thermal transfer recording web roll, and the innermost layer of the thermal transfer recording web roll is fixed to the second innermost layer of the thermal transfer recording web roll. The rotative driving device is combined with the thermal transfer recording web roll. Since the thermal transfer recording web roll rotates together with the holding device, any core is not necessary for holding the thermal transfer recording web roll, the thermal transfer recording web roll can be prepared at a low cost without requiring much time and effort, and an image of an excellent image quality can be formed by thermal transfer printing.

Fifth Embodiment

Figure 26:
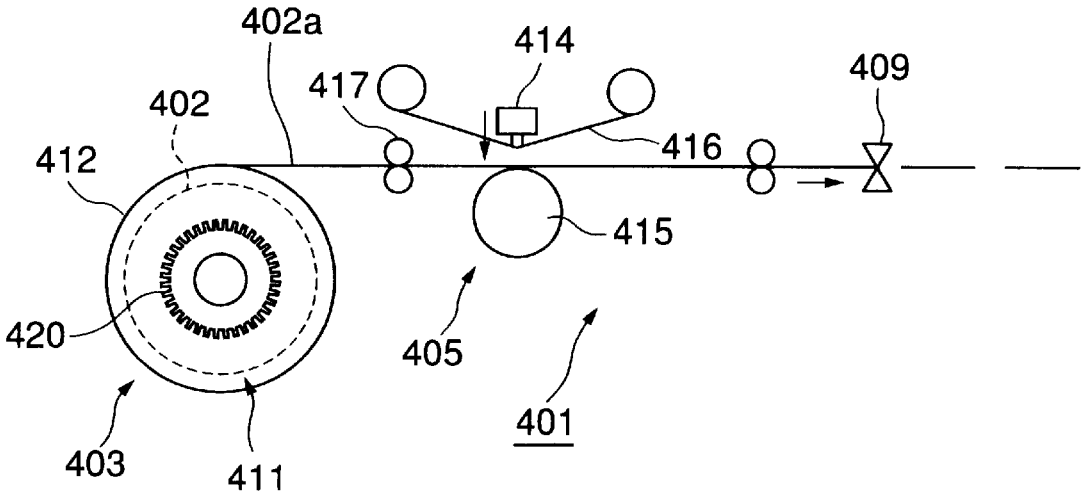
FIG. 26 is a schematic view of a thermal transfer printer in a fifth embodiment according to the present invention.

FIGS. 26 to 34 are schematic views of a fifth embodiment of the present invention. Referring to FIG. 26, a thermal transfer printer 401 has a coreless recording web roll 402 formed by rolling a thermal transfer recording web 402*a*, a recording web feed unit 403 holding the recording web roll 402, a pair of flanged tubular shafts 410 and 411 holding the recording web roll 402 and respectively provided with slits 418*a* and 418*b*, a thermal transfer recording unit 405 that operates for thermal transfer recording, and a cutting unit 409 for cutting the thermal transfer recording web 402*a* into sheets.

The recording web roll 402 is formed by rolling the thermal transfer recording web 402*a*, and has an innermost layer 406 the recording web roll 402 and bonded to the second innermost layer 407*a* of the recording web roll 402.

The thermal transfer recording web 402*a* is pulled out from the recording web feed unit 403 by feed rollers 417 in the direction of the arrow such that the leading edge of a section of the thermal transfer recording web 402*a* is located at a print-starting position. Then, the feed rollers 417 are reversed and the thermal transfer recording web roll 402 is turned in a winding direction to move the thermal transfer recording web 402*a* for printing in a direction opposite to the direction of the arrow. The thermal transfer recording web 402*a* is extended tautly between the flanged tubular shafts 410 and 411, and the feed rollers 417. An operation for feeding and winding the thermal transfer recording web 402*a* is controlled mainly by rotating the feed rollers 417 in the normal or the reverse direction. The flanged tubular shafts 410 and 411 is interlocked with the feed rollers 417 so as to rotate the thermal transfer recording web roll 402 according to the rotation of the feed rollers 417 to unwind or wind the thermal transfer recording web 402*a* subordinately to the operation of the feed rollers 417. Although it is preferable that the thermal transfer recording web roll 402 does not slip relative to the flanged tubular shafts 410 and 411, the thermal transfer recording web roll 402 may slip in some degree relative to the flanged tubular shafts 410 and 411, provided that the thermal transfer recording web 402*a* is neither folded nor creased.

The thermal transfer recording unit 405 is provided with a thermal transfer sheet 416 and a thermal head 414. The thermal head 414 is brought into contact with the back surface of the thermal transfer sheet 416. The thermal transfer recording web 402*a* is extended with its recording surface in contact with the surface coated with a transfer layer (the front surface) of the thermal transfer sheet 416. A platen roller 415 is disposed opposite to the thermal head 414 so as to be in contact with the back surface of the thermal transfer recording web 402*a*. When printing an image by thermal transfer recording on the thermal transfer recording web 402*a*, the thermal head 414 is lowered in the direction of the arrow to transfer a color image from the thermal transfer sheet 416 to the thermal transfer recording web 402*a*.

Preferably, two guide members, not shown, are extended along the opposite side edges of the thermal transfer recording web 402*a,* respectively, between the recording web feed unit 403 and the thermal transfer recording unit 405 to prevent the thermal transfer recording web 402*a* from meandering.

Desirably, the distance between the two guide members is adjustable according to the width of the thermal transfer recording web 402*a*. For example, pins and dice which engage with each other are attached to parts of the thermal transfer printer 401 to which the guide members are attached, the plurality of dice are attached to a member, and the member provided with the dice and a member provided with the pins are slid relative to each other. The pins are fitted in the dice located at positions corresponding to the width of the thermal transfer recording web 402*a*. Thus, the thermal transfer recording web 402*a* slides along the guide members, the guide members restrain the thermal transfer recording web 402*a* from lateral movement and hence the thermal transfer recording web 402*a* is prevented from meandering.

The cutting unit 409 of the thermal transfer printer 401 cuts the thermal transfer recording web 402*a* into sheets. The printed thermal transfer recording web 402*a* may be taken up in a printed thermal transfer recording web roll.

Figure 27:
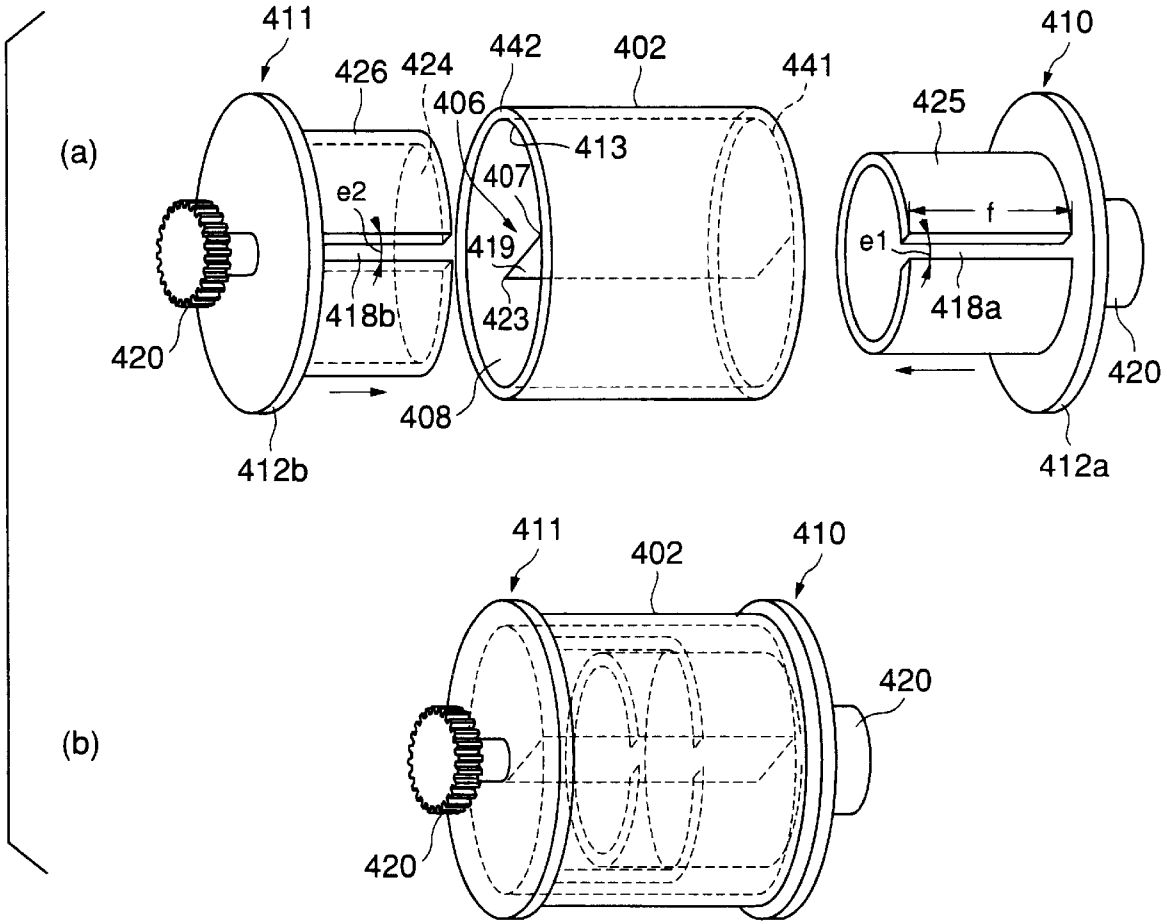
FIGS. 27(*a*) and 27(*b*) are schematic perspective views of assistance in explaining a procedure for fitting flanged tubular shafts on a thermal transfer recording web roll.

FIGS. 27(*a*) and 27(*b*) are views of assistance in explaining a method of fitting the flanged tubular shafts 410 and 411 on the thermal transfer recording web roll 402. FIG. 27(*a*) shows a state before the flanged tubular shafts 410 and 411 are fitted in the central 408 of the thermal transfer recording web roll 402. The flanged shafts 410 and 411 are provided with slits 418*a* and 418*b* and flanges 412*a* and 412*b,* respectively. The flanged tubular shafts 410 and 411 are provided with gears 420, which are engaged with gears, not shown, of the thermal transfer printer 401. Only the flanged shaft 411 may be provided with the gear 420. The thermal transfer recording web roll 402 is formed by rolling the thermal transfer recording web 402*a* without using any core and has an inner end segment 419. The inner end segment 419 may be formed by either of two rolling methods. In one of the rolling methods the inner end segment 419 forming the innermost layer of the recording web roll 402 is bent at a part 407 which is at an optional distance from the inner end edge 423 of the thermal transfer recording web 402*a* in a direction perpendicular to the rolling direction, before rolling the thermal transfer recording web 402*a*. In another rolling method, the thermal transfer recording web roll 402 is formed first, and then the inner end segment 419 is bent at a part 407 which is at an optional distance from the inner end edge 423 of the thermal transfer recording web 402*a*. The part 407 is bonded to the second innermost layer 407*a* of the thermal transfer recording web roll 402.

The positions of the flanged tubular shafts 410 and 411 are adjusted so that the slits 418*a* and 418*b* thereof correspond to the inner end segment 419 of the thermal transfer recording web roll 402, and then the flanged tubular shafts 410 and 411 are inserted in the directions of the arrows, respectively, into the central bore 408 as far as the inner surfaces of the of the flanges 412*a* and 412*b* come into contact with the end surfaces 441 and 442 of the thermal transfer recording web roll 402, respectively. A tubular part 425 of the flanged tubular shaft 410 is fitted in the tubular part 424 of the flanged tubular shaft 411. Consequently, the flanged tubular shafts 410 and 411 are fitted on the thermal transfer recording web roll 402 as shown in FIG. 27(*b*).

Subsequently, the flanged tubular shafts 410 and 411 are turned in opposite directions, respectively, to hold the inner end segment 419 of the thermal transfer recording web roll 402 between the slits 418*a* and 418*b,* and then the flanged tubular shaft 411 is turned in a direction in which the thermal transfer recording web 402*a* is wound to form the thermal transfer recording web roll 402 to tighten the thermal transfer recording web roll 402. Consequently, the thermal transfer recording web roll 402 having the inner end part 419 and the flanged shafts 410 and 411 are united firmly together.

As shown in FIG. 27, the flange tubular shaft 410 has the flange 412*a* to be brought into contact with the end surface 441 of the thermal transfer recording web roll 402, and the tubular part 425 provided with the slit 418*a* and to be inserted in the central bore 408 of the thermal transfer recording web roll 402, and the flanged tubular shaft 411 has the flange 412*b* to be brought into contact with the end surface 442 of the thermal transfer recording web roll 402, the tubular part 418*b* provided with the slit 418*b* and to be inserted in the bore 408 of the thermal transfer recording web roll 402, and the gear 420. Only the flanged tubular shaft 411 may be provided with the gear 420 as shown in FIG. 27, or both the flanged tubular shafts 410 and 411 may be provided with the gears 420, the rotative driving force of the thermal transfer printer 401 may be transmitted through the flanged tubular shafts 410 and 411 to rotate the thermal transfer recording web roll 402.

The flanges 412*a* and 412*b* of the flanged tubular shafts 410 and 411 shown in FIG. 27 may be provided in their circumferences with gear teeth and the gears 420 maybe omitted, and each of the tubular parts 425 and 426 may be provided with a plurality slits.

When the flanged tubular shaft 410 and 411 are used for supporting thermal transfer recording web rolls of thermal transfer recording webs respectively having different widths, the length f of the slits 418*a* and 418*b* of the flanged tubular shafts 410 and 411 must be adjustable, and the distance between the inner side surfaces of the flanges 412*a* and 412*b* must be adjusted to a value not smaller than the width of the thermal transfer recording web.

Figure 28:
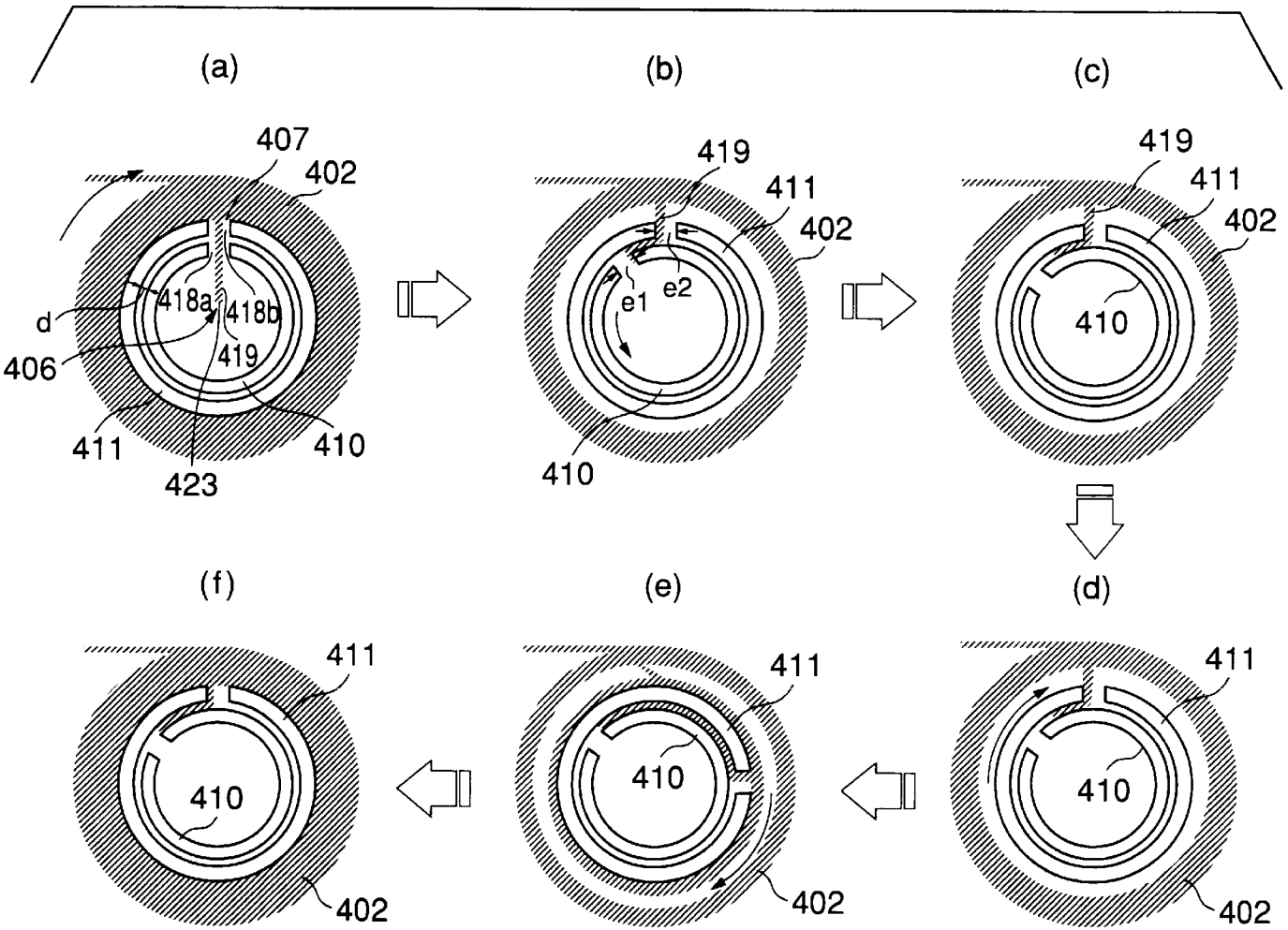
FIGS. 28(*a*) to 28(*f*) are end views of assistance in explaining a process in which a segment of a thermal transfer recording web forming the innermost layer of a thermal transfer recording web roll employed in the present invention is caught by a flanged shaft.

FIGS. 28(*a*) to 28(*f*) are end views of assistance in explaining a process in which the inner end segment 419 of innermost layer 406 of the thermal transfer recording web roll 402 is held between the flanged shafts 410 and 411.

As shown in FIG. 28(*a*), the segment 419 of the thermal transfer recording web roll 402 is bent at the part 407 perpendicularly to the rolling direction. The tubular parts 425 and 426 of the flanged tubular shafts 410 and 411 are inserted into the opposite end segment of the central bore 408 of the thermal transfer recording web roll 402 with the slits 418*a* and 418*b* of the flanged tubular shafts 410 and 411 aligned with each other so that the inner end segment 419 is extended through the slits 418*a* and 418*b*. The inner end segment 419 extends through the substantially middle parts of the slits 418*a* and 418*b* of the flanged tubular shafts 410 and 411. Preferably, the inner end segment 419 is long and the length of the same is substantially equal to the half of the inside diameter of the tubular part 426 of the flanged shaft 411.

Then, as shown in FIG. 28(*b*), the flanged tubular shaft 410 is turned in the direction of the arrow relative to the flanged tubular shaft 411 to hold the inner end segment 419 between the flanged tubular shafts 410 and 411. The flanged tubular shaft 410 can be turned through the gear 420 thereof by the thermal transfer printer 401.

The flanged tubular shaft 410 is turned further relative to the flanged tubular shaft 411 to a position shown in FIG. 28(*c*).

Then, the flanged tubular shaft 411 is turned from a position shown in FIG. 28(*c*) in the direction of the arrow shown in FIG. 28(*d*) relative to the flanged shaft 410 to wind the thermal transfer recording web roll 402 tight. The flanged shaft 411 can be thus turned through the gear 420 by the thermal transfer printer 401.

Then, the flanged shaft 411 is turned further from a position shown in FIG. 28(*d*) in the direction of the arrow vie a state shown in FIG. 38(*e*) to a state shown in FIG. 28(*f*). In the state shown in FIG. 28(*f*), the innermost layer of the thermal transfer recording web roll 402 is in close contact with the tubular part 426 of the flanged shaft 411 and the flanged shaft 411 cannot be turned any further.

Thus the inner end segment 406 of the thermal transfer recording web roll 402 is in close contact with the tubular part 426 of the flanged tubular shaft 411, and the flanged shafts 410 and 411 are fastened firmly to the thermal transfer recording web 402, so that the thermal transfer recording web roll 402 is able to be turned together with the flanged shafts 410 and 411. Desirably, a gap between the respective tubular parts 425 and 426 of the flanged shafts 410 and 411 is slightly greater than the thickness of the thermal transfer recording web 402*a* by a value, for example, in the range of several micrometers to several tens micrometers.

The gap d is formed between the respective tubular parts 425 and 426 of the flanged shafts 410 and 411 because the outside diameter of the tubular part 425 of the flanged shaft 410 and the inside diameter of the tubular part 426 of the flanged shafts 411 are different. Although the flanged shafts 410 and 411 can be fastened together when the gap d is small, the flanged shaft 411 cannot be easily turned relative to the flanged shaft 410 to wind the thermal transfer recording web roll 402 tight if the gap d is excessively small. If the gap d is excessively big, the tubular part 425 of the flanged shaft 410 rattles in the tubular part 426 of the flanged shaft 411, and the flanged shafts 410 and 411 are combined eccentrically. Consequently, problems arise in the accuracy of rotating the thermal transfer recording web roll 402 to feed the thermal transfer recording web 402*a* and driving the thermal transfer recording web roll 402 by the thermal transfer printer.

Figure 31:
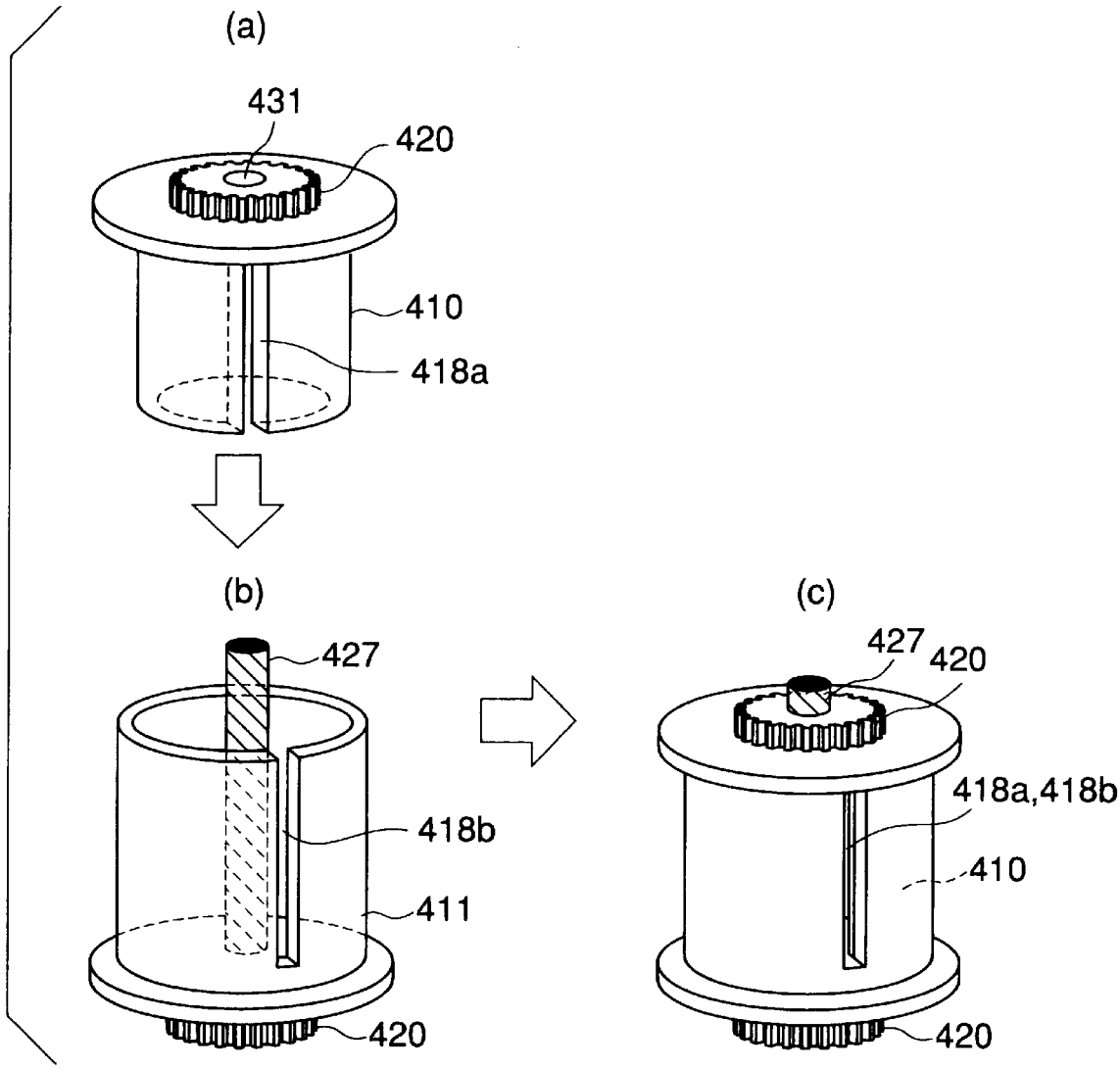
FIGS. 31(*a*) to 31(*c*) are perspective views of assistance in explaining a method of fitting a flanged tubular shaft provided with a central rod on a thermal transfer recording web roll.

The gap d can be adjusted properly by forming the tubular part 425 of the flanged shaft 410 in a proper outside diameter and forming the tubular part 426 of the flanged tubular shaft 411 in a proper inside diameter. Flanged tubular shafts 410 and 411 shown in FIG. 31 are so designed as to prevent the tubular parts thereof from rattling relative to each other. The flanged tubular shaft 411 is provided with a central rod 427, and the flange of the flanged shaft 410 is provided with a central bore 431. The flanged shaft 411 is fitted in the bore of a thermal transfer recording web roll 402 and the free end part of the central rod 427 is fitted in the central hole 431 of the flange of the flanged shaft 410 to prevent the tubular parts of the flanged shafts 410 and 411 from rattling relative to each other. Flanged tubular shafts 410 and 411 shown in FIG. 34 maybe used. If a big gap d is formed between the tubular parts 425 and 426 of the flanged shafts 410 and 411, a circular ring 434 is formed on the inner side surface of the flange 412*b* of the flanged shaft 411, and the free end of the tubular part 425 of the flanged shaft 410 is fitted in the circular ring 434. Since the position of the flanged shaft 410 relative to the flanged shaft 411 is fixed by the ring 434, the flanged shafts 410 and 411 are prevented from rattling while the same are rotated.

The respective widths $e_1$ and $e_2$ of slits 418*a* and 418*b* formed in the tubular parts 425 and 426 of the flanged shafts 410 and 411 are determined so that the inner end part 419 of the thermal transfer recording web 402*a* can be held between the flanged shafts 410 and 411 when the flanged shafts 410 and 411 are turned relative to each other. Generally, it is proper that the thickness of the thermal transfer recording web 402*a* is far less than the width $e_2$ of the flanged shaft 411, and the width $e_2$ is not greater than the width $e_1$ of the slit 418*a* of the flanged shaft 410.

Preferably, a perforated line or a pressed line is formed in the part 407 of the inner end segment 406 to facilitate bending the inner end segment 406 in a radial direction along the part 407.

Figure 29:
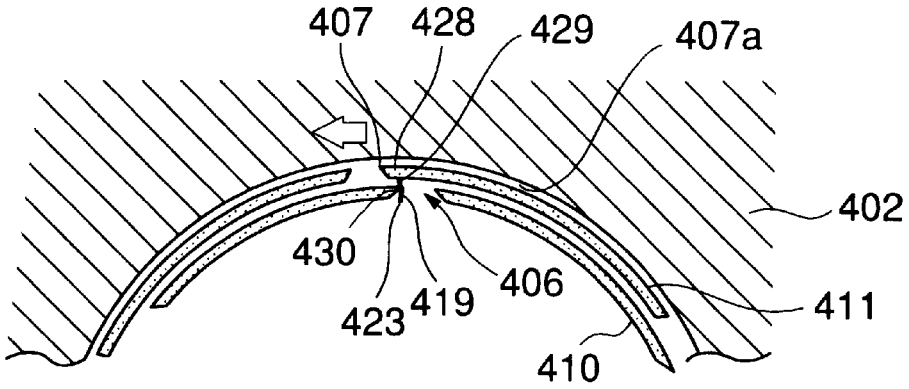
FIG. 29 is a schematic view of assistance in explaining a state in which a segment of a thermal transfer recording web forming the innermost layer of a thermal transfer recording web roll employed in the present invention is caught between flanged tubular shafts.

FIG. 29 is a view of assistance in explaining a state in which an inner end segment 419 of a thermal transfer recording web roll 402 is held between flanged shafts 410 and 411, which are different from those shown in FIG. 28.

Referring to FIG. 29, the inner end segment 419 of the thermal transfer recording web roll 402 is passed through slits 418*a* and 418*b* formed respectively in the tubular parts of the flanged shafts 410 and 411, the flanged shaft 410 is turned clockwise and the flanged shaft 411 is turned counterclockwise. In this state, parts of an inner end part 419 corresponds to edges 428 and 429 of the tubular part of the flanged shafts 411 and an edge 430 of the tubular part of the flanged shaft 410. Thus, the inner end segment 419 is pulled when the flanged shaft 411 is turned counterclockwise.

Then, the flanged shaft 410 is turned clockwise to pull the inner end part 419 and the flanged shaft 411 is turned in a winding direction to wind the thermal transfer recording web roll 402 tight. Consequently, the inner end segment 419 of the thermal transfer recording web roll 402 is fastened to the flanged shafts 410 and 411. Since the inner end segment 419 is bent at comparatively sharp angles by the edges 428 and 430 in the state shown in FIG. 29, friction between the inner end segment 419 and the flanged shafts 410 and 411 is high and hence the thermal transfer recording web roll 402 can be fastened more firmly to the flanged shafts 410 and 411 than that shown in FIG. 28.

Figure 30:
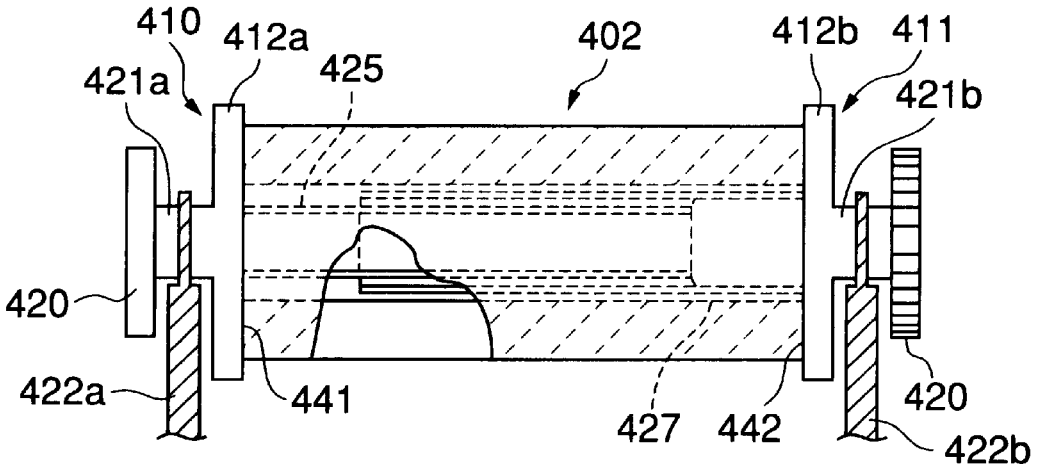
FIG. 30 is a schematic view of a thermal transfer recording web roll according to the present invention loaded into a thermal transfer printer.

FIG. 30 is a schematic view of a thermal transfer recording web roll 402 according to the present invention loaded into a thermal transfer printer 401. A shaft 421*a* projecting from the flanged shaft 410 is supported for rotation on a support member 422*a* of the thermal transfer printer 401, and a shaft 421*b* projecting from the flanged shaft 411 is supported for rotation on a support member 422*b* of the thermal transfer printer 401. A drive gear, not shown, of the thermal transfer printer is engaged with a gear 420 attached to the flanged shaft 411 to drive the thermal transfer recording web roll 402 for rotation. Since the flanged shafts 410 and 411 are supported for rotation on the support members 422*a* and 422*b* of the thermal transfer printer 401, the thermal transfer recording web roll 202 does not make eccentric rotation. The respective flanges 412*a* and 412*b* of the flanged shafts 410 and 444 are pressed against the opposite end surfaces 441 and 442 of the thermal transfer recording web roll 402 to protect the end surfaces 441 and 442 from abrasion when the thermal transfer recording web roll 402 is rotated.

As shown in FIG. 30, the respective tubular parts 425 and 426 of the flanged shafts 410 and 411 are inserted in the bore 408 of the thermal transfer recording web roll 402. The outside diameter of the tubular part 426 of the flanged shaft 411 is smaller than the diameter of the bore 408 of the thermal transfer recording web roll 402 by a value in the range of several micrometers to several tens micrometers. The outside diameter of the tubular part 425 of the flanged shaft 410 is smaller than the inside diameter of the tubular part 426 of the flanged shaft 411 by a value in the range of several micrometers to several tens micrometers. Thus the tubular part 426 of the flanged shaft 411 comes into contact with the inner surface of the bore 408 when the same is inserted in the bore 408. The tubular part 425 of the flanged shaft 410 is inserted into the tubular part 426 of the flanged shaft 411. The respective tubular parts 425 and 426 of the flanged shafts 410 and 411 are provided with slits 418*a* and 418*b*, respectively. The inner end segment 419 of the thermal transfer recording web 402*a* of the thermal transfer recording web roll 402 is inserted in the slits 418*a* and 418*b* of the flanged shafts 410 and 411, the flanged shafts 410 and 411 are turned in opposite directions, respectively, to hold the inner end segment 419 firmly between the flanged shafts 410 and 411.

When the flanged shaft 410 and 411 are used for supporting thermal transfer recording web rolls of thermal transfer recording webs respectively having different widths, the length f of the slits 418*a* and 418*b* of the flanged shafts 410 and 411 may be adjustable, a mark indicating a correct position for the inner end part 419 maybe formed in the tubular part 426 of the flanged shaft 411 or slits 418*b* of lengths corresponding to the sizes of different thermal transfer recording web rolls 402 may be formed only in the flanged shaft 411 at greatest possible angular intervals. The slits 418*a* of the flanged shaft 410 may be formed so as to conform to the greatest one of the widths of the thermal transfer recording webs to be used and the slit 418*a* of the flanged shaft 410 may be aligned with the slit 418*b* of the flanged shaft 411 conforming to the size of the thermal transfer recording web to be used among those formed in the tubular part 426 of the flanged shaft 411.

FIG. 31 is a view of assistance in explaining a method of putting a flanged shaft 411 provided with a central rod 427 on a thermal transfer recording web roll 402 according to the present invention. The flanged shaft 411 is provided with the central rod 427, and the other flanged shaft 410 is provided with a hole 431 to receive an end part of the central rod 427. Thus, the flanged shafts 410 and 411 can be correctly combined by fitting the end part of the central rod 427 of the flanged shaft 411 in the hole 431 of the other flanged shaft 410. The center rod 427 may be locked in place by a locking means after the end part thereof has been fitted in the hole 431 to restrain the flanged shafts 410 and 411 from movement relative to each other.

Figure 32:
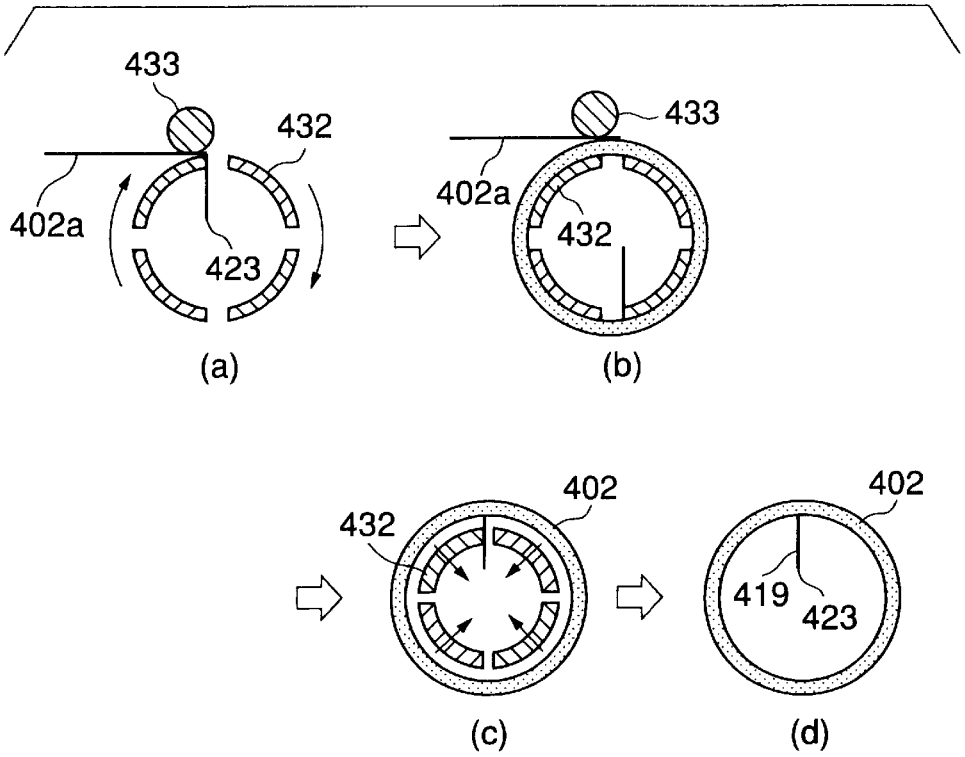
FIGS. 32(*a*) to 32(*d*) are schematic end views of assistance in explaining a method of forming a thermal transfer recording web roll according to the present invention.

FIGS. 32(*a*) to 32(*d*) are views of assistance in explaining a procedure for winding a thermal transfer recording web 402*a* to form a thermal transfer recording web roll 402.

Referring to FIG. 32(*a*), a winding shaft 432 is divided into four parts spaced by gaps. An inner edge 423 of the thermal transfer recording web 402*a* is inserted in one of the gaps of the winding shaft 432. At this stage, the winding shaft 432 expands in a big diameter because any high compressive force is not exerted on the winding shaft 432.

As shown in FIG. 32(*b*), the thermal transfer recording web 402*a* is pressed against the circumference of the winding shaft 432 by a pressure roller 433 and is wound around the winding shaft 432 to form a thermal transfer recording web roll 402. The winding shaft 432 is compressed radially as indicated by the arrows in FIG. 32(*c*). Then, the winding shaft 432 is extracted from the thermal transfer recording web roll 402 to provide a coreless thermal transfer recording web 402 having a free inner end segment 419.

Figure 33:
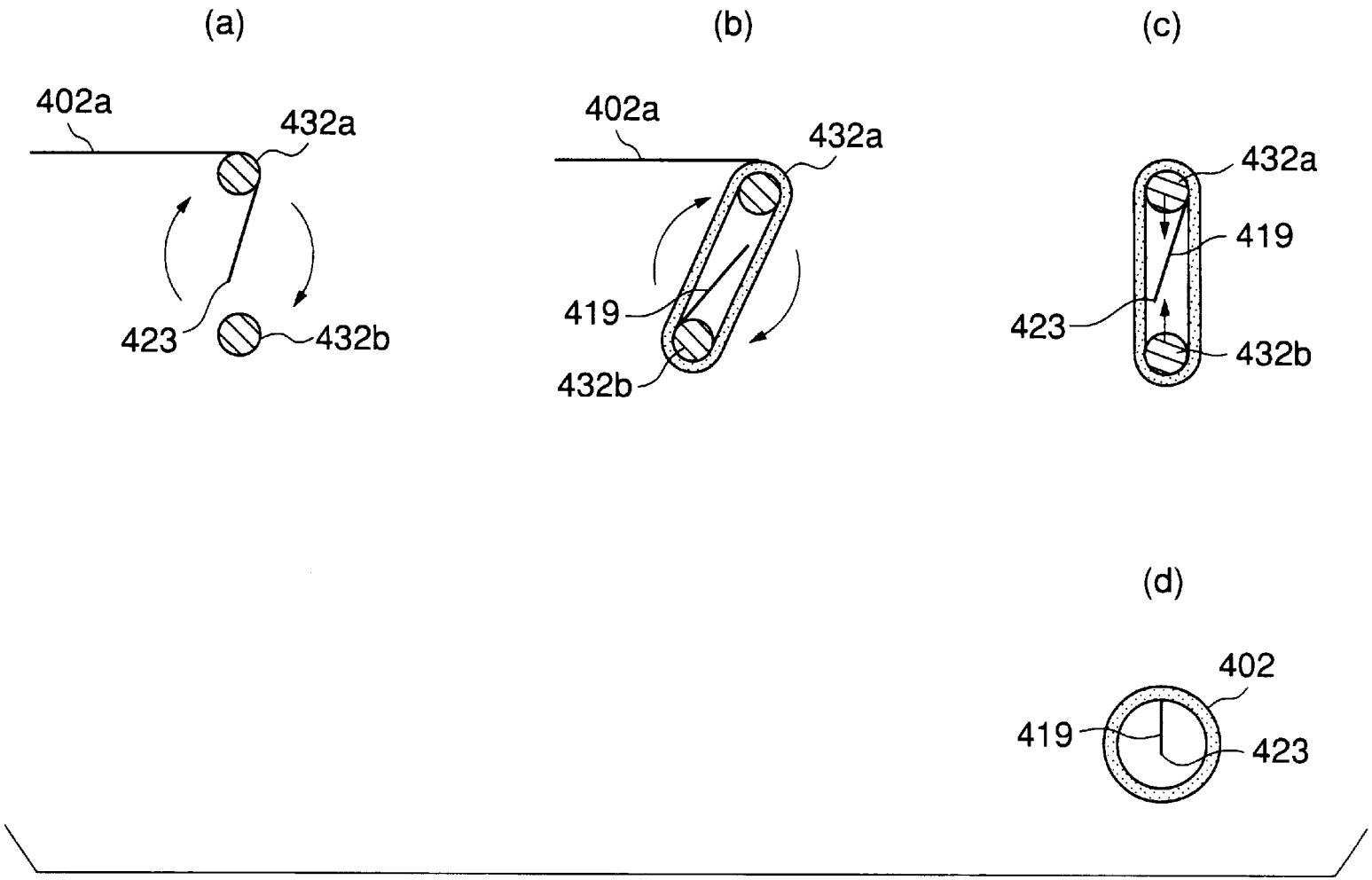
FIGS. 33(*a*) to 33(*d*) are views of assistance in explaining a method of forming a thermal transfer recording web roll according to the present invention.
Figure 34:
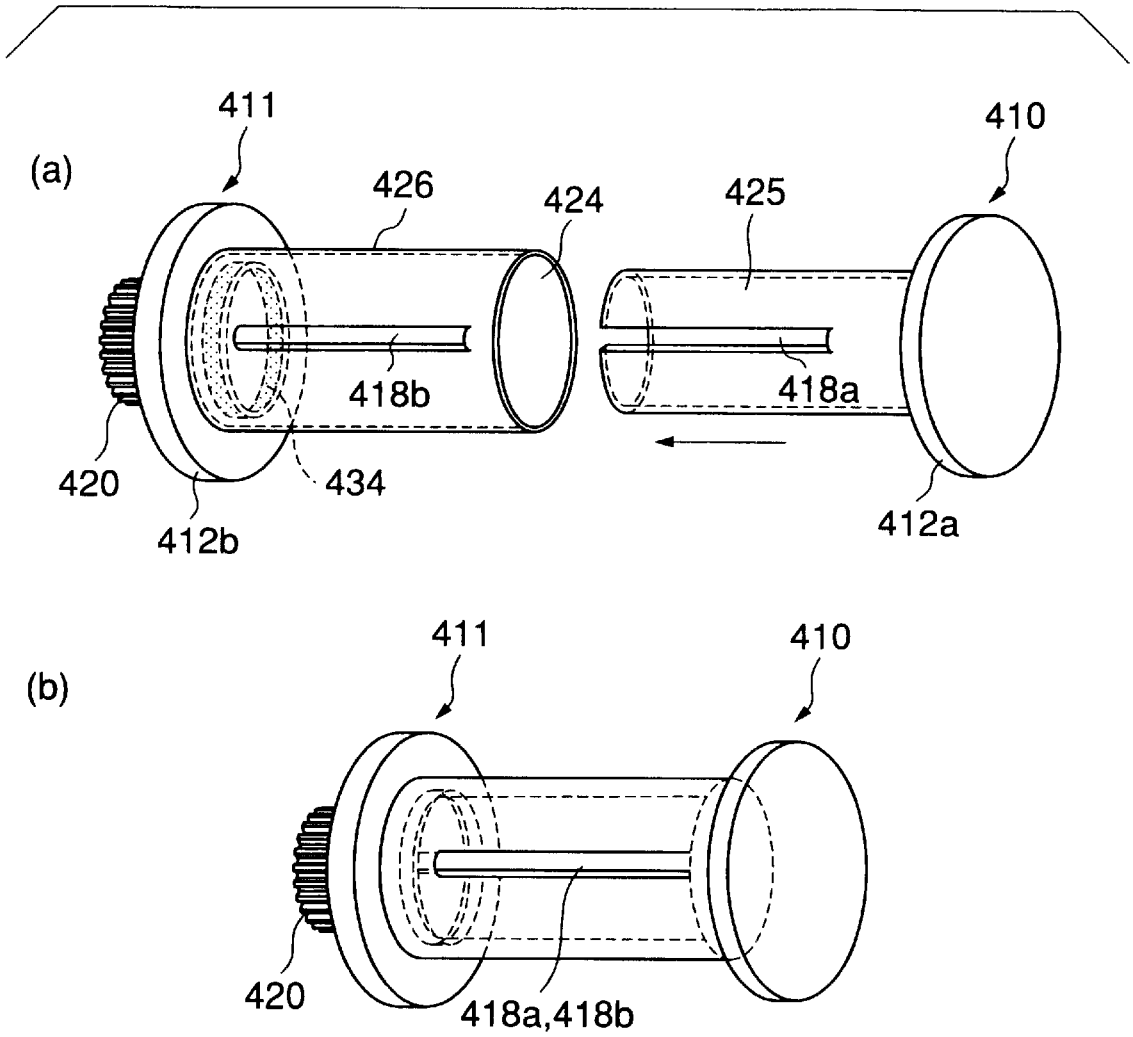
FIGS. 34(*a*) and 34(*b*) are perspective views assistance in explaining a means for preventing flanged shafts from rattling relative to each other.

FIGS. 33(*a*) to 33(*d*) are views of assistance in explaining another procedure for winding a thermal transfer recording web 402*a* to form a thermal transfer recording web roll 402.

Referring to FIG. 33(*a*), winding shafts 432*a* and 432*b* are supported on a rotary mechanism at a fixed center distance. A thermal transfer recording web 402*a* is extended between the winding shafts 432*a* and 432*b* so that an inner end segment 419 extends beyond the winding shaft 432*b*. Then, the rotary mechanism turns the winding shafts 432*a* and 432*b* about an axis passing the middle point between the center axes of the winding shafts 432*a* and 432*b* to wind the thermal transfer recording web 402*a* in a loop as shown in FIG. 33(*b*).

Then, as shown in FIG. 33(*c*), the center distance between the winding shafts 432*a* and 432*b* is reduced and the winding shafts 432*a* and 432*b* are extracted from the loop to provide a coreless thermal transfer recording web roll 402 having the free inner end part 419 as shown in FIG. 33(*d*).

According to the present invention, it is important that the inner end segment 419 of the thermal transfer recording web roll 402 is firmly fastened to the flanged shafts 410 and 411 so that the inner end segment 419 does not slip relative to the flanged shafts 410 and 411 or slips in some degree that does not affect print quality. Preferably, the thermal transfer recording web 402*a* employed in the present invention is provided with a conventional dye-recipient layer capable of receiving and fixing dyes.

Preferably, the flanged shafts 410 and 411 are formed of a resin suitable for injection molding, such as a polystyrene resin, a vinyl chloride resin, a polycarbonate resin or a polyester resin, by molding.

A thermal transfer recording method according to the present invention inserts the flanged shaft 411 in the bore 408 of the thermal transfer recording web roll 402, and inserts the tubular part 425 of the flanged shaft 410 in the tubular part 426 of the flanged shaft 411 so that the inner end segment 419 of the thermal transfer recording web roll 402 is extended through the slits 418*a* and 418*b* of the flanged shafts 410 and 411. Then, the flanged shafts 410 and 411 are turned in opposite directions, respectively, to hold the inner end segment 419 between the tubular parts 425 and 426 of the flanged shafts 410 and 411, and then the flanged shaft 411 is turned in a winding direction to wind the thermal transfer recording web roll 402 tight. Consequently, the thermal transfer recording web roll 402 is fastened firmly to the flanged shafts 410 and 411. The flanged shafts 410 and 411 are driven for rotation through the gears 420 to rotate the thermal transfer recording web roll 402 for thermal transfer recording.

As apparent from the foregoing description, according to the present invention, the thermal transfer printer of the following construction enables the preparation of a thermal transfer recording web roll not requiring any feed core, at a low cost without requiring time and effort, and is capable of recording a thermal transfer image in a satisfactory image quality.

The respective tubular parts 425 and 426 of the flanged shafts 410 and 411 are inserted in the cenral bore of the thermal transfer recording web roll 402 formed by rolling a thermal transfer recording web 402*a* without using any core. The respective tubular parts 425 and 426 of the two flanged shafts 410 and 411 are provided with the slits 418*a* and 418*b*, respectively. The inner end segment 419 of the thermal transfer recording web 402*a* of the thermal transfer recording web roll 402 is passed through the slits 418*a* and 418*b* of the flanged shafts 410 and 411, the flanged shafts 410 and 411 are turned in opposite directions, respectively, to hold the inner end segment 419 between the tubular parts 425 and 426 of the flanged shafts 410 and 411, and then the flanged shaft 411 is turned in the winding direction to wind the thermal transfer recording web roll 402 tight. Thus, the thermal transfer recording web roll 402 and the flanged shaft 411 are fastened firmly together. The flanged shaft 11 is driven through the gear 420 to rotate the flanged shafts 410 and 411 together with the thermal transfer recording web roll 402 for thermal transfer recording.

What is claimed is:

1. A thermal transfer printer comprising:

a thermal transfer recording web roll having a bore and obtained by rolling a thermal transfer web, in which a segment of the thermal transfer recording web forming an innermost layer of the thermal transfer recording web roll is fixed to a part of a segment of the same forming a second innermost layer of the thermal transfer recording web roll;

a rotative driving mechanism inserted in the bore of the thermal transfer recording web roll; and a thermal transfer recording unit for recording images on the thermal transfer recording web unwound from the thermal transfer recording web roll held by the rotative driving mechanism.

2. The thermal transfer printer according to claim 1, wherein the segment of the innermost layer of the thermal transfer recording web excluding an inner edge part is fixed to the part of the second innermost layer, and the rotative driving mechanism includes a holding device for holding the inner edge part of the thermal transfer recording web.

3. The thermal transfer printer according to claim 2, wherein the holding device has a holding rod having a diameter substantially equal to that of the bore of the thermal transfer recording web roll, and having in its circumference a recess for holding the inner edge part of the thermal transfer recording web.

4. The thermal transfer printer according to claim 2, wherein the holding device has a holding rod having a diameter substantially equal to that of the hollow part of the thermal transfer recording web roll, and having a groove to receive the inner edge part of the thermal transfer recording web.

5. The thermal transfer printer according to claim 2, wherein the holding device is provided with a pair of drive shafts for holding the inner edge part of the thermal transfer recording web.

6. The thermal transfer printer according to claim 1, wherein the rotative driving mechanism includes a pair of caps disposed on opposite end surfaces of the thermal transfer recording web roll, respectively, so as to be engaged in the bore of the thermal transfer recording web roll.

7. The thermal transfer printer according to claim 6, wherein at least one of the caps has elastic parts for applying pressure radially outward to an inner surface of the bore of the thermal transfer recording web roll.

8. The thermal transfer printer according to claim 6 wherein at least one of the caps has a flange in contact with the end surface of the thermal transfer recording web roll.

9. The thermal transfer printer according to claim 6, wherein one of the caps has elastic parts for applying pressure radially outward to an inner surface of the bore of the thermal transfer recording web roll, and the other cap has a part to be inserted into the former cap to press the elastic parts radially outward.

10. The thermal transfer printer according to claim 6, wherein each of the pair of caps is held in the bore of the thermal transfer recording web roll through a bushing provided with a slit.

11. The thermal transfer printer according to claim 7, wherein a slit is formed between the adjacent elastic parts of the cap.

12. The thermal transfer printer according to claim 10, wherein the segment of the inner most layer of the thermal transfer recording web roll excluding an inner edge part is fixed to the part of the second innermost layer, and the inner edge part is inserted in the slit formed in the bushing or the slit of the cap.

13. The thermal transfer printer according to claim 1, wherein the rotative driving mechanism includes drive rollers disposed in the bore of the thermal transfer recording web roll in contact with an inner surface of the bore of the thermal transfer recording web roll.

14. The thermal transfer printer according to claim 13, wherein the rotative driving mechanism includes a pair of drive rollers, and center distance between the pair of drive rollers is adjustable.

15. The thermal transfer printer according to claim 14, wherein the pair of drive rollers are biased away from each other.

16. The thermal transfer printer according to claim 13, wherein the drive rollers have an outer circumference provided with ridges or knobs.

17. The thermal transfer printer according to claim 1, wherein the rotative driving mechanism includes a plurality of drive rollers disposed in the bore of the thermal transfer recording web roll, and an endless belt extended around the plurality of drive rollers and pressed by the plurality of drive rollers so as to be in contact with an inner surface of the bore of the thermal transfer recording web roll.

18. The thermal transfer printer according to claim 1, wherein the rotative driving mechanism includes a pair of rotative driving members disposed at opposite end surfaces of the thermal transfer recording web roll and capable of applying pressure to the opposite end surfaces of the thermal transfer recording web roll.

19. The thermal transfer printer according to claim 18, wherein the pair of rotative driving members have taper side surfaces tapering toward the end surfaces of the thermal transfer recording web roll, respectively.

20. The thermal transfer printer according to claim 18, wherein the pair of rotative driving members are mounted on a center shaft inserted in the bore of the thermal transfer recording web roll.

21. The thermal transfer printer according to claim 20, wherein at least one of the pair of rotative driving members is pressed by a spring mounted on the center shaft against the end surface of the thermal transfer recording web roll.

22. The thermal transfer printer according to claim 20, wherein distance between the rotative driving members mounted on the center shaft is adjustable.

23. The thermal transfer printer according to claim 1, wherein the segment of the innermost layer of the thermal transfer recording web roll excluding an inner end part, is fixed to the part of the second innermost layer, and the rotative driving mechanism includes a pair of flanged tubular shafts each having a tubular part provided with a slit.

24. The thermal transfer printer according to claim 23, wherein the tubular part of one of the flanged tubular shafts is inserted into the tubular part of the other flanged tubular shaft.

25. The thermal transfer printer according to claim 24, wherein one of the flanged tubular shafts is provided with a central rod connected to the other flanged tubular shaft.

26. The thermal transfer printer according to claim 23, wherein the pair of flanged tubular shafts are driven individually by separate driving mechanisms, respectively.

27. The thermal transfer printer according to claim 23, wherein the pair of flanged tubular shafts are supported for rotation by support members, respectively.

28. A thermal transfer recording method comprising the steps of:

preparing a thermal transfer recording web roll having a bore and obtained by rolling a thermal transfer web, in which a segment of the thermal transfer recording web forming an innermost layer of the thermal transfer recording web roll is fixed to a part of a segment of the same forming a second innermost layer of the thermal transfer recording web roll;

unwinding the thermal transfer recording web by engaging a rotative driving mechanism in the bore of the thermal transfer recording web roll and rotating the thermal transfer recording web roll by the rotative driving mechanism; and carrying out a thermal transfer recording operation to record an image on the thermal transfer recording web unwound from the thermal transfer recording web roll.

29. The thermal transfer recording method according to claim 28, wherein the segment of the innermost layer of the thermal transfer recording web roll excluding an inner edge part is fixed to a part of the second innermost layer, and the thermal transfer recording web roll is driven for rotation by the rotative driving mechanism including a holding device holding the inner edge part of the thermal transfer recording web.

30. The thermal transfer recording method according to claim 28, wherein the rotative driving mechanism includes a pair of caps disposed at opposite end surfaces of the thermal transfer recording web roll, respectively, so as to be engaged in the bore of the thermal transfer recording web roll.

31. The thermal transfer recording method according to claim 28, wherein the rotative driving mechanism includes drive rollers disposed in the bore of the thermal transfer recording web roll in contact with an inner surface of the bore of the thermal transfer recording web roll.

32. The thermal transfer recording method according to claim 28, wherein the rotative driving mechanism includes a pair of rotative driving members disposed at opposite end surfaces of the thermal transfer recording web roll, respectively, and capable of applying pressure to the end surfaces of the thermal transfer recording web roll.

33. The thermal transfer recording method according to claim 28, wherein the segment of the innermost layer of the thermal transfer recording web roll excluding an inner end part, is fixed to the part of the second innermost layer, and the thermal transfer web roll is driven for rotation by the rotative driving mechanism including a pair of flanged tubular shafts each having a tubular part provided with a slit.

* * * * *